US011287196B2

(12) United States Patent
Macedo et al.

(10) Patent No.: US 11,287,196 B2
(45) Date of Patent: Mar. 29, 2022

(54) HELICALLY BAFFLED HEAT EXCHANGER

(71) Applicant: LUMMUS TECHNOLOGY LLC, Bloomfield, NJ (US)

(72) Inventors: Eric Drew Macedo, Houston, TX (US); Richard John Jibb, Houston, TX (US); Sherif Elsayed, Houston, TX (US); Melanie O'Sullivan, Houston, TX (US)

(73) Assignee: LUMMUS TECHNOLOGY LLC, Bloomfield, NJ (US)

( * ) Notice: Subject to any disclaimer, the term of this patent is extended or adjusted under 35 U.S.C. 154(b) by 2 days.

(21) Appl. No.: 16/428,582

(22) Filed: May 31, 2019

(65) Prior Publication Data

US 2020/0378697 A1 Dec. 3, 2020

(51) Int. Cl.

| | |
|---|---|
| ***F28F 9/22*** | (2006.01) |
| ***F28F 9/02*** | (2006.01) |
| ***F28F 9/24*** | (2006.01) |

(52) U.S. Cl.

CPC ..... *F28F 9/22* (2013.01); *F28F 9/0219* (2013.01); *F28F 9/0236* (2013.01); *F28F 9/24* (2013.01);

(Continued)

(58) Field of Classification Search

CPC .... F28F 9/22; F28F 9/24; F28F 9/0219; F28F 9/0236; F28F 9/0243; F28F 9/04; F28F 2009/222; F28F 2009/224; F28F 2009/226; F28F 2009/228; F28F 9/0221; F28F 2230/00; F28F 2240/00

(Continued)

(56) References Cited

U.S. PATENT DOCUMENTS 1,525,094 A * 2/1925 Jones ..... F28F 9/22 165/161
1,782,409 A * 11/1930 Chute ..... F28F 9/22 165/161

(Continued)

FOREIGN PATENT DOCUMENTS

CN 1584482 B 10/2010
CN 105431702 A 3/2016

(Continued)

OTHER PUBLICATIONS

Effects of sealing strips on shell-side flow . . . —Yang (Dec. 2013) (Year: 2013).*

(Continued)

*Primary Examiner* — Len Tran
*Assistant Examiner* — Jenna M Hopkins
(74) *Attorney, Agent, or Firm* — Seed IP Law Group LLP

(57) ABSTRACT

A heat exchanger including a shell having a longitudinal axis, a plurality of baffles, such as elliptical sector-shaped baffles, each mounted in the shell at a helix angle $H_B$ to guide a fluid flow into a helical pattern through the shell. Each of the plurality of baffles includes an outer circumferential edge, a proximal radial edge, a distal radial edge, a proximal side, a distal side, and a plurality of spaced apart holes that are traversed by a plurality of axially extending tubes. Each of the first plurality of seal strips is disposed from a proximal of the plurality of baffles to a distal of the plurality of baffles.

29 Claims, 12 Drawing Sheets

(52) U.S. Cl.
CPC ..... *F28F 9/0221* (2013.01); *F28F 9/0243* (2013.01); *F28F 2009/222* (2013.01); *F28F 2009/224* (2013.01); *F28F 2009/226* (2013.01); *F28F 2009/228* (2013.01); *F28F 2230/00* (2013.01); *F28F 2240/00* (2013.01)

(58) Field of Classification Search
USPC ..... 165/158–161
See application file for complete search history.

(56) References Cited

U.S. PATENT DOCUMENTS 2,036,957 A * 4/1936 Price ..... F28D 7/005 165/81
2,384,714 A * 9/1945 Villiger ..... F28F 9/22 165/161
2,693,942 A * 11/1954 Guala ..... F28F 9/22 165/161
3,400,758 A * 9/1968 Lee ..... F28F 9/22 165/159
3,708,142 A * 1/1973 Small ..... F28F 9/0132 138/112
4,127,165 A * 11/1978 Small ..... F28F 9/0132 165/162
4,360,059 A * 11/1982 Funke ..... F28D 7/026 165/160
4,493,368 A * 1/1985 Gronnerud ..... F28F 9/0131 165/159
4,561,498 A * 12/1985 Nowobilski ..... F28F 9/22 165/160
4,697,637 A * 10/1987 Young ..... F28F 9/0132 165/159
4,787,440 A * 11/1988 Young ..... F28F 9/0132 165/159
4,823,866 A * 4/1989 Hunt ..... C12M 41/24 165/162
4,882,283 A * 11/1989 Gentry ..... C12M 41/24 435/289.1
5,217,066 A * 6/1993 Killebrew ..... F28F 9/00 165/160
5,327,957 A * 7/1994 Killebrew ..... F28F 9/00 165/159
6,827,138 B1 * 12/2004 Master ..... F28F 9/22 165/159
7,234,512 B2 * 6/2007 Anderson ..... F28D 7/1607 165/103
7,740,057 B2 * 6/2010 Wang ..... F28D 7/1607 165/161
8,391,696 B2 * 3/2013 McClanahan ..... F28F 9/22 392/491
8,613,308 B2 * 12/2013 Daly ..... F28F 1/40 165/163
8,728,219 B2 * 5/2014 McClanahan ..... B01D 3/143 96/218
10,371,422 B2 * 8/2019 Moreaux ..... B01D 5/0009
10,670,312 B2 * 6/2020 Maurer ..... F28D 3/04
2003/0116306 A1 * 6/2003 Besik ..... F28D 7/1607 165/109.1
2009/0301699 A1 * 12/2009 Karrs ..... F28F 9/22 165/159
2010/0193167 A1 * 8/2010 Song ..... F28F 9/22 165/159
2012/0312514 A1 * 12/2012 Erickson ..... B21D 53/06 165/163
2014/0020876 A1 * 1/2014 Rolland ..... F28F 13/12 165/165
2016/0018168 A1 * 1/2016 Urbanski ..... F28D 7/16 165/159
2019/0063853 A1 * 2/2019 Tatavarthy ..... F28F 9/22

FOREIGN PATENT DOCUMENTS

EP 1067352 A1 * 1/2001 ..... B01F 5/0619
JP 59012294 A * 1/1984 ..... F28F 9/24
JP 59044585 A * 3/1984 ..... F28F 9/24

OTHER PUBLICATIONS

Sealing Strips in Tubular Heat Exchangers—Taylor (Aug. 1987) (Year: 1987).*
International Search Report issued in International Application No. PCT/US2020/034659 dated Sep. 15, 2020 (3 pages).
Written Opinion issued in International Application No. PCT/US2020/034659 dated Sep. 15, 2020 (11 pages).
Office Action issued in corresponding TW Application No. 109118177 dated May 3, 2021 (18 pages).

* cited by examiner

HELICALLY BAFFLED HEAT EXCHANGER

BACKGROUND

Heat-exchanging assemblies target increased performance by maximizing the ratio of heat transfer to pressure drop, whilst providing reduced installation and maintenance costs and effective protection against damage from vibration, or loss of efficiency due to fouling.

Whether it is the offshore, refinery, power, petrochemical, or paper and food industries, heat exchangers are often the core of the above-enumerated objectives. Numerous configurations of heat exchangers are known and used for a variety of applications. One of the widely used configurations of heat exchangers is a shell and tube heat exchanger, as shown in FIG. 1 by way of example. The shell and tube heat exchanger of FIG. 1 includes a cylindrical shell 10 that houses a bundle of parallel tubes 11, which extend between two end plates 12. A first fluid 13 flows in and through the space between the two end plates so as to come into contact with the bundle of parallel tubes 11, through which a second fluid 14 passes through. To provide an improved heat exchange between the two fluids, the flow of the first fluid 13 is defined by intermediate baffles 15 forming respective compartments, which are arranged so that the flow of the first fluid 13 changes its direction in passing from one compartment to the next. The baffles 15, configured as circular segments, are installed perpendicular to a longitudinal axis 16 of the shell 10 to provide a zigzag flow 17 of the first fluid 13.

Disadvantageously, in shell and tube heat exchangers, such as the heat exchanger shown in FIG. 1, the second fluid has to sharply change the direction of its flow several times along the length of the shell. These sharp changes in flow direction cause a reduction in the dynamic pressure of the second fluid and non-uniform flow velocity thereof, which, in combination, adversely affect the performance of the heat exchanger. Further, cleaning of shell and tube heat exchangers requires that the bundle of parallel tubes 11 be removed from the shell 10 or else only clean fluids can be used as the first fluid 13 that is flowed within the shell 10 of the shell and tube heat exchanger. Making the bundle of parallel tubes 11 removable requires sufficient clearance between the bundle of parallel tubes 11 and the shell 10 to allow for non-damaging removal. Typically the gap between the bundle of parallel tubes 11 and the shell 10 is large enough that a significant amount of the first fluid 13 to be heated or cooled will bypass the bundle of parallel tubes 11 and mix with the first fluid 13 that has been heated or cooled at the outlet of the shell and tube heat exchanger.

Referring still to shell and tube heat exchangers (e.g., the heat exchanger shown in FIG. 1), it is well known that a perpendicular position of baffles relative to the longitudinal axis of the shell results in a relatively inefficient heat transfer rate/pressure drop ratio, because the baffles produce a large form drag. Adjacent baffles extending parallel to one another and at a right angle with respect to the longitudinal axis of the shell define a cross flow path characterized by numerous sharp turns between adjacent channels. The efficiency of heat transfer can be improved by reducing the spacing between the baffles. However, decreasing the spacing results in large recirculation zones and forces a larger fraction of the flow to leak between the tubes and the baffle and along the outer edges of the baffles. The non-uniformity of flow distribution within each segment defined between the adjacent baffles causes numerous eddies, stagnation regions, and expansion/contraction, which decreases a local temperature difference. A further factor contributing to a decreased heat transfer rate is attributed to the fact that the tubes traversed by the first fluid have to be positioned at a certain radial distance from the shell. Accordingly, the cross flow around the peripherally located tubes is faster than around centrally mounted tubes.

Thus, conventional baffle arrangement as described above results in flow bypass through baffle-to-shell clearances and flow leakage through tube-to-baffles clearances. Bypass and leakage flow reduces the cross-flow heat transfer while the flow maldistribution caused by significant velocity variations increases back-flow and eddies in the dead zones, which in turn leads to the disposition of fouling materials on the outside of the tubes of the bundle of tubes. If the heat exchanger is left to continue operating after disposition of fouling materials within the shell, then a significant loss in performance will be experienced over time, which will translate into an increase in operating cost and consumption of energy. If the heat exchanger is removed from service to be cleaned due to the buildup of fouling materials, there will be a loss or reduction in production, which translates into an operating cost similar to or higher than the value of the heat exchanger. Further, heat exchangers that are left in a fouled state for too long will develop hardened deposits, which will be difficult to remove and can cause corrosion in local regions with higher temperatures. The bundle of tubes on which the hardened deposits develop and on which corrosion occurs may deteriorate to a point where the bundle of tubes must be removed from service and the damaged tubes are plugged.

Furthermore, conventional arrangement may experience flow-induced vibration of the tubes since long tubes reaching often 24-feet long are supported by a succession of baffles which, in order to solve the problem associated with the non-uniform velocity, are spaced apart at a substantial distance.

Helically baffled heat exchangers have been used to overcome the problem of non-uniform flow in shell and tube heat exchangers. A helical pattern of the first fluid flow may allow for a particularly effective conversion of available pressure drop to heat transfer and may reduce the risk of vibration of the bundle of parallel pipes. However, the helical baffles may have large gaps which allow the first fluid flow to leak around the baffles and may result in both a reduced velocity across the bundle of tubes and a lower thermal efficiency due to the loss of a temperature driving force. These problems may particularly occur when a removable bundle of tubes with a large tube to shell clearance is desired. Further, bypassing of the bundle of tubes may also be particularly severe when cooling a viscous liquid whereby the viscosity of a liquid after it has been cooled is significantly higher than the viscosity of the liquid when it enters the heat exchanger. In other words, a warmer, less viscous liquid can easily flow around and bypass the bundle of tubes compared to a cooled, more viscous liquid.

In order to help prevent bypass of the baffles of a helically baffled heat exchanger, sealing devices have been used. The sealing devices for such helically baffled heat exchangers have been of substantially the same type as the sealing devices used for the conventional baffles and have been relatively ineffective in preventing bypass in the helically baffled heat exchangers. In addition, since the helically baffled heat exchangers have a generally lower pressure drop than a segmentally baffled heat exchanger, the penalty associated with the pressure drop induced by the sealing devices relative to the improvement in heat transfer is relatively high. The sealing devices used in conventional baffled heat exchangers may provide, at best, a minor improvement in heat transfer, and may, at worst, interfere with the helical flow path in the bundle, thereby causing a significant reduction in heat transfer.

SUMMARY OF INVENTION

It is desirable to configure a baffle assembly that can attain uniformity of fluid flow without recirculation, dead zones, or leakage/bypassing of the heat transfer surfaces. Further, it is desirable to configure a baffle assembly with positioning of multiple baffles and sealing devices to maintain a higher heat transfer rate within acceptable pressure drop and vibration limits. Additionally, a baffle assembly that allows for facilitated maintenance of the bundle of tubes by providing a larger tube to shell clearance to allow rapid removal and replacement for cleaning and repair is desirable. Embodiments disclosed herein address one or more of these.

Embodiments of the disclosure may provide a heat exchanger. The heat exchanger may include a shell having a longitudinal axis and configured to receive a first fluid. Further, the heat exchanger may include a plurality of elliptical sector-shaped baffles each mounted in the shell at an angle to the longitudinal axis to guide a first fluid flow into a helical pattern through the shell. Furthermore, the heat exchanger may include a first plurality of seal strips having a first end and a second end radially disposed between the shell and a plurality of axially extending tubes. Additionally, each of the plurality of baffles may include an outer circumferential edge longitudinally spaced apart from the outer circumferential edge positions of the rest of the plurality of baffles, a proximal radial edge spaced from a distal radial edge, a proximal side opposite from a distal side, and a plurality of spaced apart holes configured to be traversed by the plurality of axially extending tubes carrying a second fluid. The first end of each of the first plurality of seal strips may be coupled to the distal side of one of the plurality of baffles between the proximal radial edge and the distal radial edge of the one of the plurality of baffles. The second end of each of the first plurality of seal strips may be coupled to the proximal side of another of the plurality of baffles between the proximal radial edge and the distal radial edge of the other of the plurality of baffles. Further, each of the first plurality of seal strips may be disposed either orthogonal to both the distal side of the one of the plurality of baffles and the proximal side of the other of the plurality of baffles or at an angle from orthogonal to the proximal side of the other of the plurality of baffles, and the angle may be from greater than 0° up to 80° in a direction defined from the proximal radial edge to the distal radial edge of the one of the plurality of baffles.

Embodiments of the disclosure may further provide a method for assembling a heat exchanger. The method may include providing a center rod having a longitudinal axis. Further, the method may include mounting a plurality of elliptical sector-shaped baffles to the center rod at an angle to the longitudinal axis of the center rod such that a helical pattern is formed by the plurality of baffles. Each of the plurality of baffles may include an outer circumferential edge longitudinally spaced apart from the outer circumferential edge positions of the rest of the plurality of baffles, a proximal radial edge spaced from a distal radial edge, a proximal side opposite from a distal side, and a plurality of spaced apart holes. Furthermore, the method may include disposing a plurality of axially extending tubes into the plurality of spaced apart holes of each of the plurality of baffles, and the plurality of axially extending tubes may carry a second fluid. Moreover, the method may include coupling a first plurality of seal strips having a first end and a second end radially between the shell and the plurality of axially extending tubes. Coupling the first plurality of seal strips may include coupling the first end of each of the first plurality of seal strips to the distal side of one of the plurality of baffles and coupling the second end of each of the first plurality of seal strips to the proximal side of another of the plurality of baffles. Each of the first plurality of seal strips may be disposed either orthogonal to both the distal side of the one of the plurality of baffles and the proximal side of the other of the plurality of baffles or at an angle from orthogonal to the proximal side of the other of the plurality of baffles, and the angle may be from greater than 0° up to 80° in a direction defined from the distal radial edge to the proximal radial edge of the one of the plurality of baffles.

In one aspect, embodiments disclosed herein relate to a heat exchanger. The heat exchanger may include a shell, a plurality of baffles, a plurality of axially extending tubes, and a plurality of seal strips. The shell may have a longitudinal axis and may be configured to receive a first fluid. A plurality of baffles, each mounted in the shell at a helix angle $H_B$, may be configured to guide a flow of the first fluid into a helical pattern through the shell. Each of the plurality of baffles may include: an outer circumferential edge longitudinally spaced apart from the outer circumferential edge positions of the rest of the plurality of baffles; a proximal radial edge spaced from a distal radial edge; a proximal side opposite from a distal side; and a plurality of spaced apart holes configured to be traversed by a plurality of the axially extending tubes configured to carry a second fluid. The plurality of seal strips each have a first end and a second end, radially disposed between the shell and the plurality of axially extending tubes and each are respectively positioned between any two longitudinally adjacent baffles, wherein each of the first plurality of seal strips is disposed from a proximal of the plurality of baffles to a distal of the plurality of baffles at a helix angle $H_s$ that is greater than 5° and less than the baffle helix angle $H_B$, where the helix angles $H_B$ and $H_s$ are defined as the angle of the respective baffle or seal strip relative to the longitudinal axis of the shell.

In some embodiments, the seal strips, in part, may be configured to direct a flow of fluid helically toward the outlet. The first plurality of seal strips may be disposed from a distal side of a first baffle from adjacent to a proximal radial edge of the first baffle to a proximal side of a second baffle adjacent to a distal radial edge of the second baffle, wherein the first and second baffles are located in a same sector or quadrant. Alternatively, the first plurality of seal strips may be disposed from a distal side of a first baffle from intermediate the proximal radial edge and distal radial edge of the first baffle to a proximal side of a second baffle intermediate a proximal radial edge and a distal radial edge of the second baffle, wherein the second baffle is located in a different sector or quadrant than the first baffle.

The first end of each of the first plurality of seal strips may, in some embodiments, be coupled to the distal side of a first of the plurality of baffles, and the second end of each of the first plurality of seal strips may be coupled to the proximal side of a second of the plurality of baffles.

The first plurality of seal strips may each have an inner surface and an outer surface. The first plurality of seal strips may be angled from the outer surface to the inner surface by an angle from orthogonal to the shell in the direction defined from a proximal radial edge to a distal radial edge of the one of the plurality of baffles.

In some embodiments, each of the first plurality of seal strips may be angled by 15° up to 45° from orthogonal to the shell such that the first fluid flow hits the seal strip at a 105° up to 135° angle.

An outer surface of each of the first plurality of seal strips may be disposed substantially proximate to an inner surface of the shell. An inner surface of each of the first plurality of seal strips, in some embodiments, may be spaced from an outer diameter of a closest tube of the plurality of axially extending tubes by a distance that is equal to a distance between outer diameters of two adjacent tubes of the plurality of axially extending tubes.

Each of the plurality of baffles may include at least one of the first plurality of seal strips coupled to the proximal side and at least one of the first plurality of seal strips coupled to the distal side of the baffle. In some embodiments, each of the first plurality of seal strips coupled to the distal side of each of the plurality of baffles may be offset rotationally about the longitudinal axis from each of the plurality of seal strips coupled to the proximal side of each of the plurality of baffles.

In some embodiments, each of the first plurality of seal strips have a curved outer diameter with a curvature that is elliptical and/or wherein each of the first plurality of seal strips have a curved inner diameter with a curvature that is elliptical.

Each of the first plurality of seal strips may have a width, outer diameter minus inner diameter, that varies along a length, first end to second end, of the seal strip, and/or wherein each of the first plurality of seal strips has a depth, proximal side to distal side, that varies along the width or the length of the seal strip.

In some embodiments, an equal number of seal strips may be coupled to each baffle of the plurality of baffles. In some embodiments, a number of seal strips per rotation about the longitudinal axis of the shell is a multiple of a number of baffles per rotation about the longitudinal axis of the shell.

Heat exchangers according to embodiments herein may further include a second plurality of seal strips, each having a first end and a second end radially disposed between the shell and the plurality of axially extending tubes and each respectively positioned between any two baffles. Each of the second plurality of seal strips may be disposed from a proximal of the plurality of baffles to a distal of the plurality of baffles at a helix angle $H_{2s}$ that is greater than 5°, different than helix angle $H_s$, and less than the baffle helix angle $H_B$, where the helix angles $H_B$, $H_s$, $H_{2s}$ are defined as the angle of the respective baffle or seal strip relative to the longitudinal axis of the shell.

Heat exchangers according to embodiments herein may include a second plurality of seal strips. Each may have a first end and a second end radially disposed between the shell and the plurality of axially extending tubes and each respectively may be positioned between any two adjacent baffles, where each of the second plurality of seal strips is disposed from a proximal radial edge of a baffle to a distal radial edge of the adjacent baffles. In some embodiments, an inner diameter of each of the second plurality of seal strips may be spaced from an outer diameter of a closest tube of the plurality of axially extending tubes by a distance that is equal to a distance between outer diameters of two adjacent tubes of the plurality of axially extending tubes.

In another aspect, embodiments herein relate to a method of assembling a heat exchanger. The method may including: providing a center rod having a longitudinal axis, and mounting a plurality of elliptical sector-shaped baffles to the center rod at an angle to the longitudinal axis of the center rod such that a helical pattern is formed by the plurality of baffles. Each of the plurality of baffles may include: an outer circumferential edge longitudinally spaced apart from the outer circumferential edge positions of the rest of the plurality of baffles; a proximal radial edge spaced from a distal radial edge; a proximal side opposite from a distal side; and a plurality of spaced apart holes; disposing a plurality of axially extending tubes into the plurality of spaced apart holes of each of the plurality of baffles, wherein the plurality of axially extending tubes are configured to carry a second fluid. The method may further include coupling a first plurality of seal strips, each having a first end and a second end, radially between the shell and the plurality of axially extending tubes. Coupling the first plurality of seal strips may include: coupling the first end of each of the first plurality of seal strips to a proximal of one of the plurality of baffles; and coupling the second end of each of the first plurality of seal strips to another, more distal, of the plurality of baffles. Each of the first plurality of seal strips may be disposed from the proximal of the plurality of baffles to the distal of the plurality of baffles at a helix angle $H_s$ that is greater than 5° and less than the baffle helix angle $H_B$, where the helix angles $H_B$ and $H_s$ are defined as the angle of the respective baffle or seal strip relative to the longitudinal axis of the shell. The method may further include disposing the assembled center rod, plurality of baffles, plurality of axially extending tubes, and first plurality of seal strips within a shell that is configured to receive a first fluid.

The coupled first plurality of seal strips may each have an inner diameter and an outer diameter. In some embodiments, coupling the first plurality of seal strips may further include: angling the coupled first plurality of seal strips from the outer diameter to the inner diameter by an angle from orthogonal to the shell in the direction defined from the proximal radial edge to the distal radial edge of the one of the plurality of baffles. In some embodiments, coupling the first plurality of seal strips may further include: spacing an inner diameter of each of the first plurality of seal strips from an outer diameter of a closest tube of the plurality of axially extending tubes by a distance that is equal to a distance between outer diameters of two adjacent tubes of the plurality of axially extending tubes. And, in some embodiments, coupling the first plurality of seal strips may further include rotationally offsetting each of the first plurality of seal strips coupled to the distal side of each of the plurality of baffles from each of the plurality of seal strips coupled to the proximal side of each of the plurality of baffles.

The method of assembly may further include coupling a second plurality of seal strips having a first end and a second end radially between the shell and the plurality of axially extending tubes. Coupling the second plurality of seal strips may include: coupling the first end of each of the second plurality of seal strips to the proximal radial edge of the distal side of one of the plurality of baffles; and coupling the second end of each of the second plurality of seal strips to the distal radial edge of the proximate side of another of the plurality of baffles, wherein each of the second plurality of seal strips extends parallel to the longitudinal axis of the shell.

In another aspect, embodiments herein are directed toward a heat exchanger. The heat exchanger may include: a shell having a longitudinal axis and configured to receive a first fluid; a plurality of baffles mounted in the shell at an angle to the longitudinal axis, spaced apart from each other along the longitudinal axis, and configured to guide a flow of the first fluid along a helical pattern through the shell, each of the baffles comprising: an outer circumferential edge; a proximal radial edge spaced from a distal radial edge; a proximal side opposite from a distal side; and a plurality of spaced apart holes formed through each baffle from the proximal side to the distal side, the holes configured to be traversed by a plurality of axially extending tubes with the tubes configured to carry a second fluid; and a plurality of seal members, each comprising a first end and a second end, the seal members radially disposed between the shell and the plurality of axially extending tubes, and the first end of each seal member coupled to the distal side of a respective baffle and the second end of each seal member coupled to the proximal side of a respective baffle. In some embodiments, the seal members may include seal strips or seal rods.

In another aspect, embodiments herein are directed toward a heat exchanger including a shell having a longitudinal axis, the shell being configured to receive a first fluid. A plurality of baffles are each mounted in the shell at a helix angle $H_B$ to guide a first fluid flow into a helical pattern through the shell. Each of the plurality of baffles may include: an outer circumferential edge longitudinally spaced apart from the outer circumferential edge positions of the rest of the plurality of baffles; a proximal radial edge spaced from a distal radial edge; a proximal side opposite from a distal side; and a plurality of spaced apart holes configured to be traversed by a plurality of axially extending tubes configured to carry a second fluid. A first plurality of circumferentially offset seal strips, each having a first end and a second end, may be radially disposed between the shell and the plurality of axially extending tubes and each may be respectively positioned between any two adjacent baffles. In some embodiments, each of the plurality of baffles is connected to at least two of the first plurality of seal strips, including a distal seal strip connected to a distal side of a baffle, and a proximal seal strip connected to a proximal side of the same baffle, and wherein the proximal seal strip is circumferentially offset from the distal seal strip. Each of the first plurality of seal strips may be parallel to a longitudinal axis of the heat exchanger in some embodiments.

Other aspects and advantages of the invention will be apparent from the following description and the appended claims.

DETAILED DESCRIPTION

Figure 1:
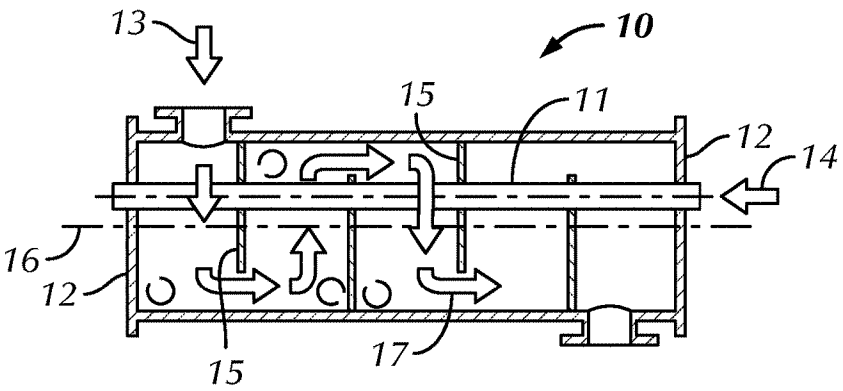
FIG. 1 (Prior Art)
FIG. 1 illustrates a diagrammatic view of flow distribution in a conventional shell and tube heat exchanger.

Embodiments of the present disclosure are described below in detail with reference to the accompanying figures. Like elements in the various figures may be denoted by like reference numerals for consistency. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description.

Figure 2:
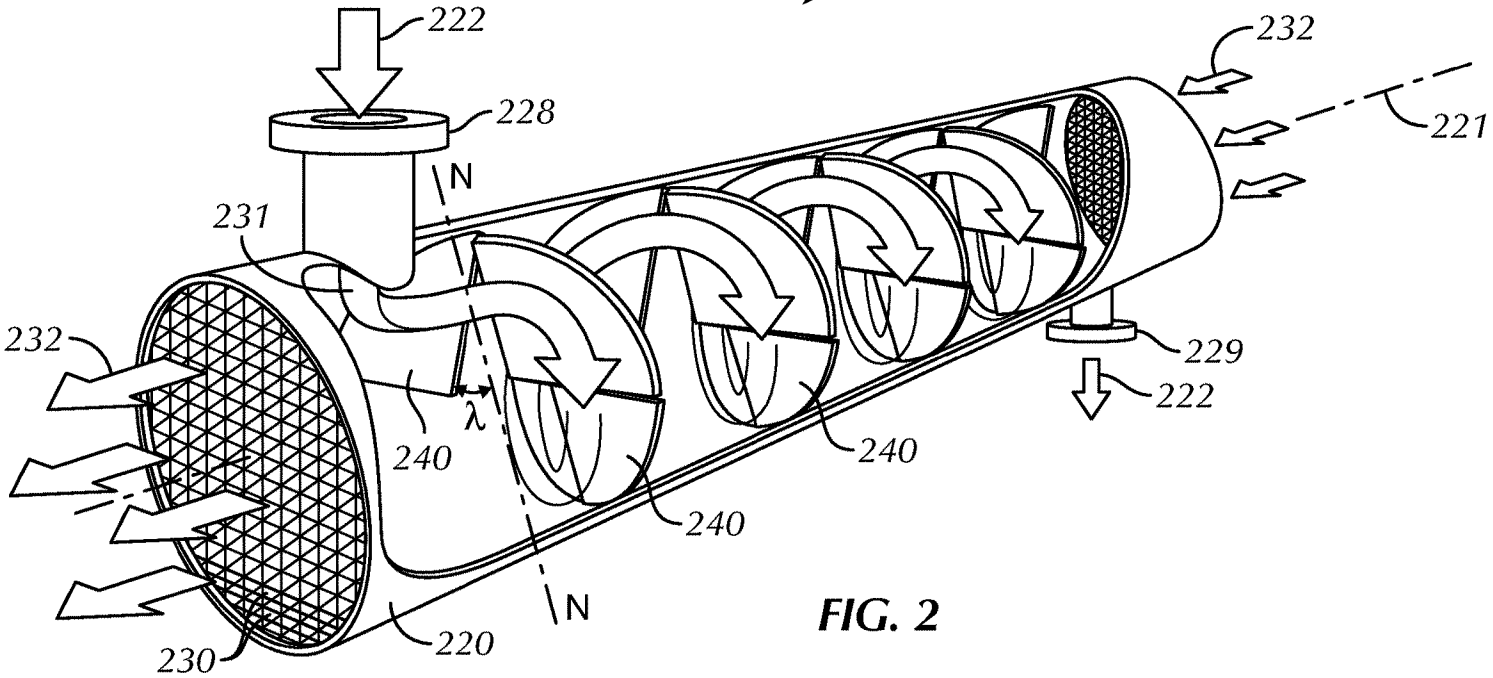
FIG. 2 illustrates a diagrammatic perspective view of a heat exchanger according to one or more embodiments of the present disclosure.

Referring to FIG. 2, in one or more embodiments, a helically-baffled heat exchanger 200 according to one or more embodiments of the present disclosure is shown. The heat exchanger 200 may include a shell 220 through which a first fluid is passed, a plurality of axially extending tubes 230 through which a second fluid is passed, and a plurality of elliptical sector-shaped baffles 240. By "elliptical sector-shaped," it should be understood that the baffles take the general form of an elliptical sector, which geometrically includes a region bounded by an arc and line segments connecting the center of the ellipse (the origin) and the endpoints of the arc, but may not be inclusive of the entire sector so as to account for other components of the heat exchanger (tubes, etc.) and the manner of installation of the baffle (e.g., encompassing or abutting a central tube, or accommodating tubes along the periphery of the elliptical sector, as illustrated in FIGS. 3 and 4, for example).

The shell 220 may include an inlet 228 and an outlet 229 between which the first fluid may pass within the shell 220. Each of the baffles 240 may be positioned at an angle $\lambda$ relative to a line (N-N) that is normal to a longitudinal axis 221 of the shell 220 in order to guide a first fluid flow 222 into a helical pattern 231 across the shell 220 from the inlet 228 to the outlet 229. The helical pattern 231 of the first fluid flow 222 may allow for an effective conversion of available pressure drop to heat transfer and reduced risk of vibration due to the fact that the unsupported tube length is minimized. In one or more embodiments, there may be no dead spots for fouling along the first fluid flow 222, and the amount of heat transfer may be increased due to elimination of eddies or back mixing. Further, in one or more embodiments, a direction of the first fluid flow 222 may be opposite to a direction of a second fluid flow 232 within the tubes 230. In other words, in one or more embodiments, the second fluid may flow in a direction that is substantially from the outlet 229 to the inlet 228. Additionally, although the baffles 240, as shown in FIG. 2, are flat, in one or more embodiments, opposite sides of each baffle may be curved to guide the first fluid flow 222 along the helical pattern.

Figure 3:
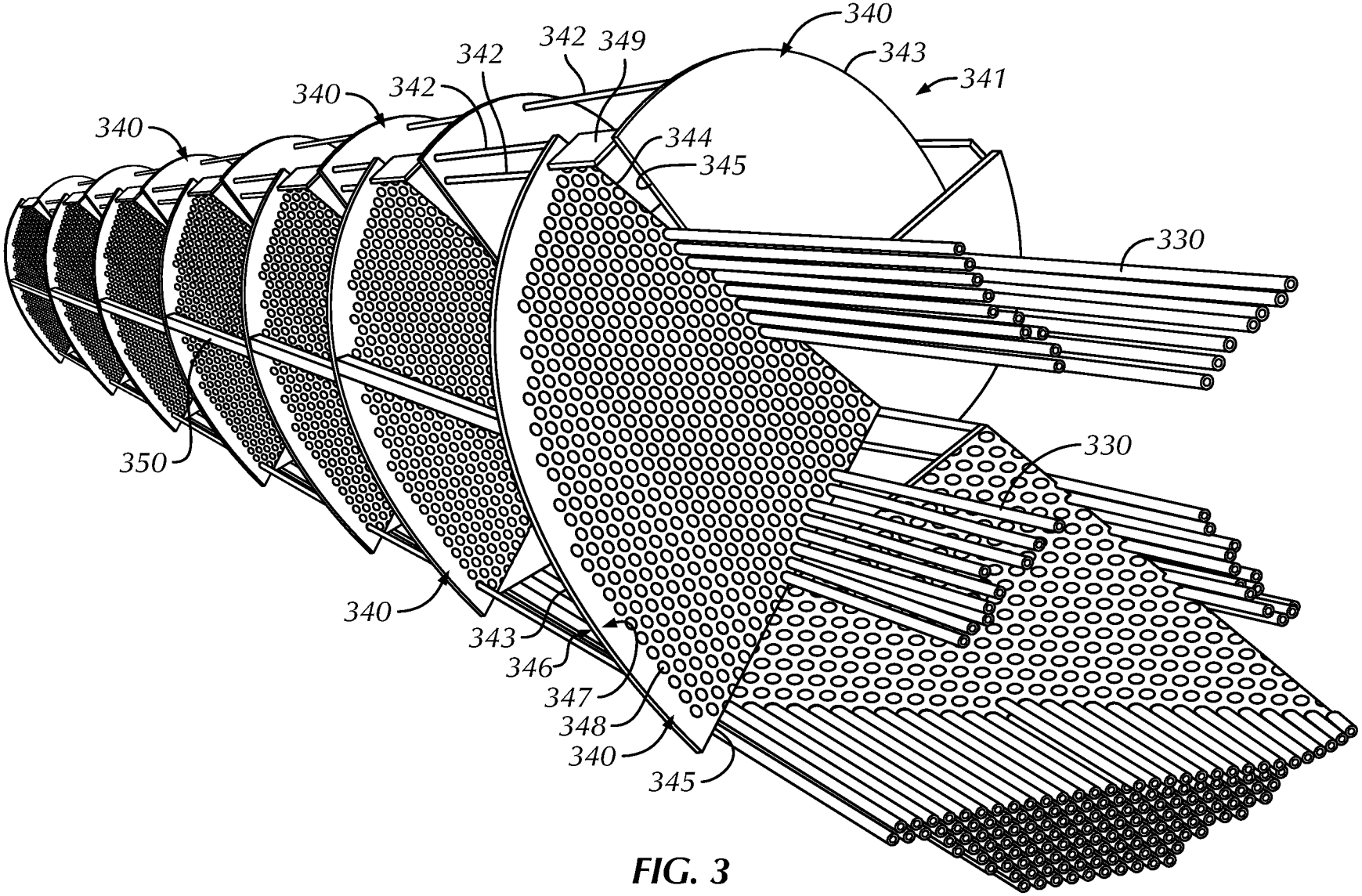
FIG. 3 illustrates a perspective view of a baffle cage of a heat exchanger according to one or more embodiments of the present disclosure.

Referring now to FIG. 3, a baffle cage 341 according to one or more embodiments of the present disclosure is shown. The baffle cage 341 may include successive baffles 340 positioned at an angle from normal to a longitudinal axis (not shown) of the baffle cage 341, and the successive baffles 340 may be rotationally and longitudinally offset from each other such that a helical pattern is formed. The rotational offset between successive baffles 340 may be such that at least a proximal radial edge 344 of one baffle 340 overlaps or abuts a distal radial edge 345 of an adjacent baffle 340 in a longitudinal direction. For example, FIG. 3 illustrates an embodiment in which a proximal radial edge 344 of each baffle 340 overlaps a distal edge 345 of the successive baffle 340. In one or more embodiments, a proximal radial edge 344 of each baffle 340 may be the radial edge of the baffle 340 that is axially closest to an inlet (not shown) of a shell (not shown) of a heat exchanger, and a distal radial edge 345 of each baffle 340 may be the radial edge of the baffle 340 that is axially farthest from the inlet of the shell of the heat exchanger. Further, in one or more embodiments, there may be an equal number of baffles 340 per 360° rotation about the longitudinal axis about which the baffles 340 are disposed. Furthermore, the baffles 340 may support multiple tubes 330 and may guide a first fluid flow (not shown) in a helical path. Additionally, in one or more embodiments, the baffles 340 may be interconnected by a plurality of rods 342. A spacer 349 may optionally be used during construction to ensure baffle spacing. As illustrated, spacer 349 is rectangular, although other shapes may be used. Still referring to FIG. 3, in one or more embodiments, each of the baffles 340 may have an outer circumferential edge 343, and each outer circumferential edge 343 may be spaced apart from the outer circumferential edge 343 of an adjacent baffle 340. Each of the baffles may also include a proximal radial edge 344 at one end of the outer circumferential edge 343 and a distal radial edge 345 at the other end of the outer circumferential edge 343 such that the elliptical sector-shaped baffles 340 are defined by the outer circumferential edge 343, the proximal radial edge 344, and the distal radial edge 345. Furthermore, each of the baffles may have a proximal side 346 and a distal side 347 that are opposite of each other as well as a plurality of spaced apart holes 348 that extend through the baffles 340 from the proximal side 346 to the distal side 347. In one or more embodiments, a proximal side 346 of each baffle 340 may be the side of the baffle 340 that is axially closest to the inlet of the shell of the heat exchanger, and a distal side 347 may be the side of each baffle 340 that is axially farthest from the inlet of the shell of the heat exchanger. One tube 330 of the plurality of axially extending tubes 330 may pass through each of the holes 348 in the baffles 340. In one or more embodiments, the holes 348 of one baffle 340 may align with holes on another baffle 340 such that the axially extending tubes 330 may fit through holes 348 and may be supported by multiple baffles 340. It is noted that, while not illustrated on all baffles 340, each of the baffles 340 may contain through holes 348.

As illustrated in FIG. 3, the tubes 330 and through holes 348 do not extend all the way to circumferential edge 343. Thus, when installed within a shell (not shown), a gap would be present between the shell and the outermost tubes 330. A tube cage 341, according to embodiments herein, may include a plurality of seal rods or seal strips 350 disposed at an angle such that the fluid flowing through the shell is, at least in part, directed back towards the tubes 330. Strips 350 may thus provide a dual function of enhanced sealing and structural support, decreasing the amount of fluid that may bypass the plurality of tubes as well as supporting the structure of the cage 341.

In addition to the sealing and structural support function of the strips 350, which may be referred to herein as seal strips, the strips 350 may be positioned in a manner so as to provide the sealing function with a low pressure drop, providing a flow barrier to prevent fluid flowing in the gap between the tubes 330 and the baffle edge 343 through the entirety of the helical flow path. The flow barrier function could alternatively be obtained by use of other structures, such as longitudinal strips having a substantially rectangular shape disposed such that the space between the tube bundle and the shell is effectively blocked; however such a flow barrier would come at the at the expense of a significant pressure drop. In contrast to longitudinal strips, embodiments herein are directed toward strips that are designed and oriented to provide enhanced sealing, structural support, and a relatively low pressure drop, as will be described more fully below.

Rods 342, as described above, are optional and may be used to additionally serve the purpose of supporting baffles during tube insertion. Thus, although rods are shown to interconnect the baffles in FIG. 3, in one or more embodiments of the present disclosure, rods are not necessary to support and interconnect the baffles 340. Instead, as shown and described in further detail below, in one or more embodiments, strips may be used to support and interconnect the baffles about a center rod.

Figure 4A:
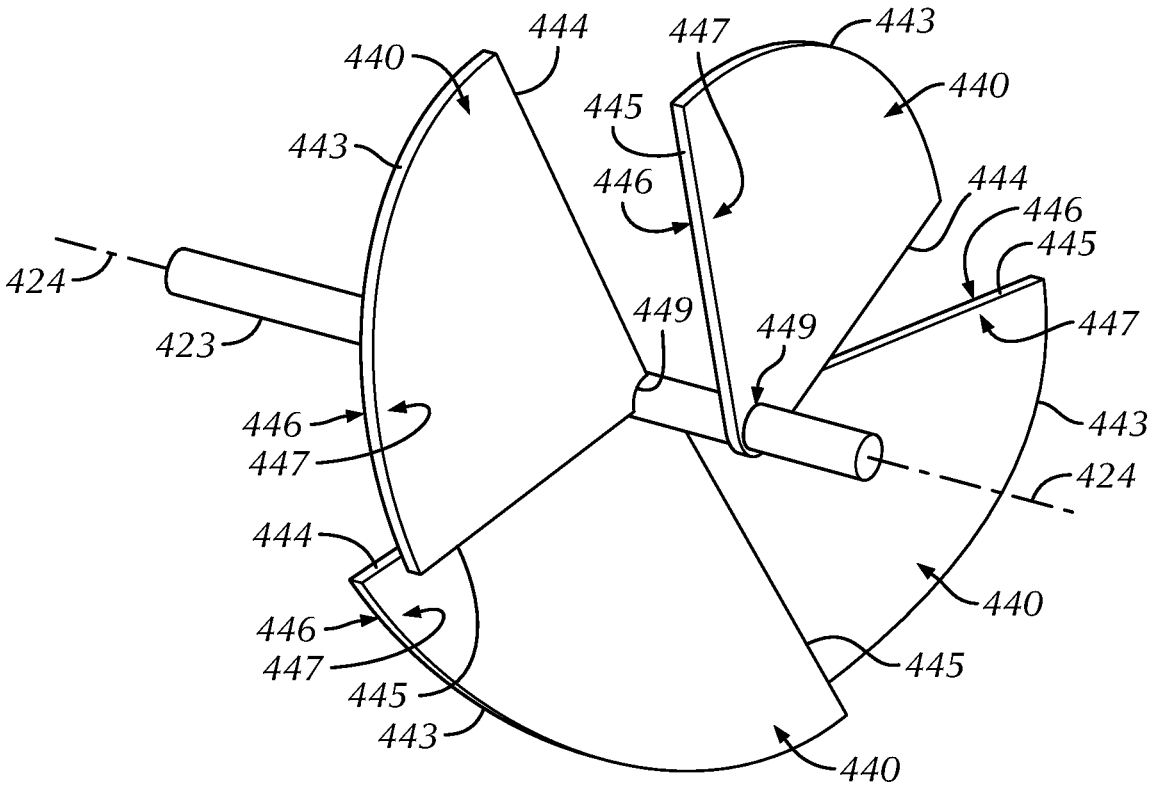
FIGS. 4A and 4B illustrate a perspective view of baffles of a heat exchanger according to one or more embodiments of the present disclosure.
Figure 4B:
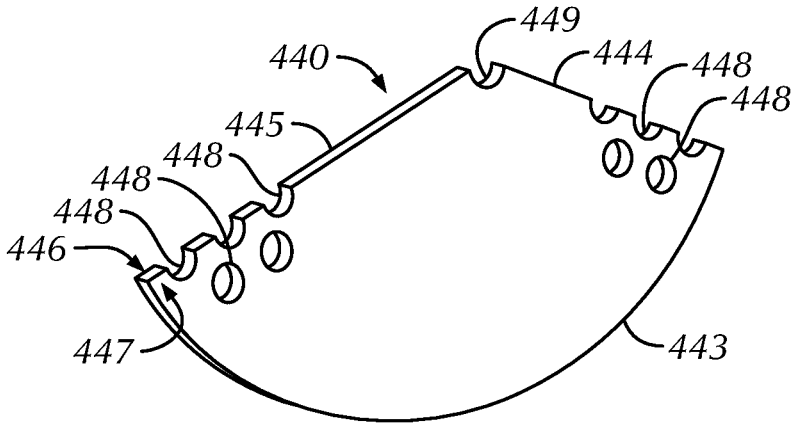

Referring now to FIGS. 4A and 4B, baffles 440 according to one or more embodiments of the present disclosure are shown. In one or more embodiments, a plurality of baffles 440 may be coupled to a center rod 423 within a shell (not shown) of a heat exchanger (not shown). Successive baffles 440 may be positioned at an angle from normal to a longitudinal axis 424 of the center rod 423, and the successive baffles 440 may be rotationally and longitudinally offset from each other such that a helical pattern is formed. The rotational offset between successive baffles 440 may be such that at least a proximal radial edge 444 of one baffle 440 overlaps a distal radial edge 445 of an adjacent baffle 440 in a longitudinal direction. In one or more embodiments, a proximal radial edge 444 of each baffle 440 may be the radial edge of the baffle 440 that is axially closest to an inlet (not shown) of a shell (not shown) of a heat exchanger, and a distal radial edge 445 of each baffle 440 may be the radial edge of the baffle 440 that is axially farthest from the inlet of the shell of the heat exchanger.

Still referring to FIGS. 4A and 4B, in one or more embodiments, the baffles 440 may be elliptical sector-shaped. Each of the baffles 440 may have an outer circumferential edge 443, and each outer circumferential edge 443 may be spaced apart from the outer circumferential edge 443 of an adjacent baffle 440. Each of the baffles may also include a proximal radial edge 444 at one end of the outer circumferential edge 443 and a distal radial edge 445 at the other end of the outer circumferential edge 443 such that the elliptical sector-shaped baffles 440 are defined by the outer circumferential edge 443, the proximal radial edge 444, and the distal radial edge 445. Furthermore, each of the baffles may have a proximal side 446 and a distal side 447 that are opposite of each other as well as a plurality of spaced apart holes 448 that extend through the baffles 440 from the first side 446 to the second side 447. In one or more embodiments, a proximal side 446 of each baffle 440 may be the side of the baffle 440 that is closest to the inlet of the shell of the heat exchanger, and a distal side 447 may be the side of each baffle 440 that is farthest from the inlet of the shell of the heat exchanger. One tube of a plurality of axially extending tubes (not shown) may pass through hole 448 in the baffles 440. In one or more embodiments, the holes 448 of one baffle 440 may align with holes on another baffle (not shown) such that the axially extending tubes may be supported by multiple baffles. Additionally, in one or more embodiments, each of the baffles 440 may include a center hole 449 at an intersection between the proximal radial edge 444 and the distal radial edge 445 through which the center rod 423 may pass in order to couple each of the baffles 440 to the center rod 423. While only a few holes 448 are illustrated in FIGS. 4A/B, one skilled in the art will understand that each baffle includes multiple holes, similar to those illustrated in FIG. 3 or 5B, for example.

The center hole 449 of each baffle 440 may be uniquely angled such that the baffles 440 are positioned at an angle from normal to a longitudinal axis 424 of the center rod 423. Further, in some embodiments the baffle angle may vary along the length of the heat exchanger, such as where proximal baffles are disposed at a first angle to the longitudinal axis and more distal baffles are disposed at a different angle to the longitudinal axis. As another example, proximal baffles may be disposed at a first angle to the longitudinal axis and more distal baffles may be successively disposed at increasing or decreasing angles to the longitudinal axis.

Referring now to FIGS. 5A-5E, multiple views of a heat exchanger 500 according to one or more embodiments of the present disclosure are shown. In one or more embodiments, a heat exchanger 500 may include a shell 520 (FIG. 5B) through which a first fluid is passed, a plurality of axially extending tubes 530 through which a second fluid is passed, a plurality of elliptical sector-shaped baffles 540, and a first plurality of seal strips 550 disposed between the baffles 540. The shell 520 may include an inlet (not shown) and an outlet (not shown) between which the first fluid may pass within the shell 520. Further, the plurality of tubes 530, the plurality of baffles 540, and the first plurality of seal strips 550 may be disposed within the shell 520.

Figure 5A:
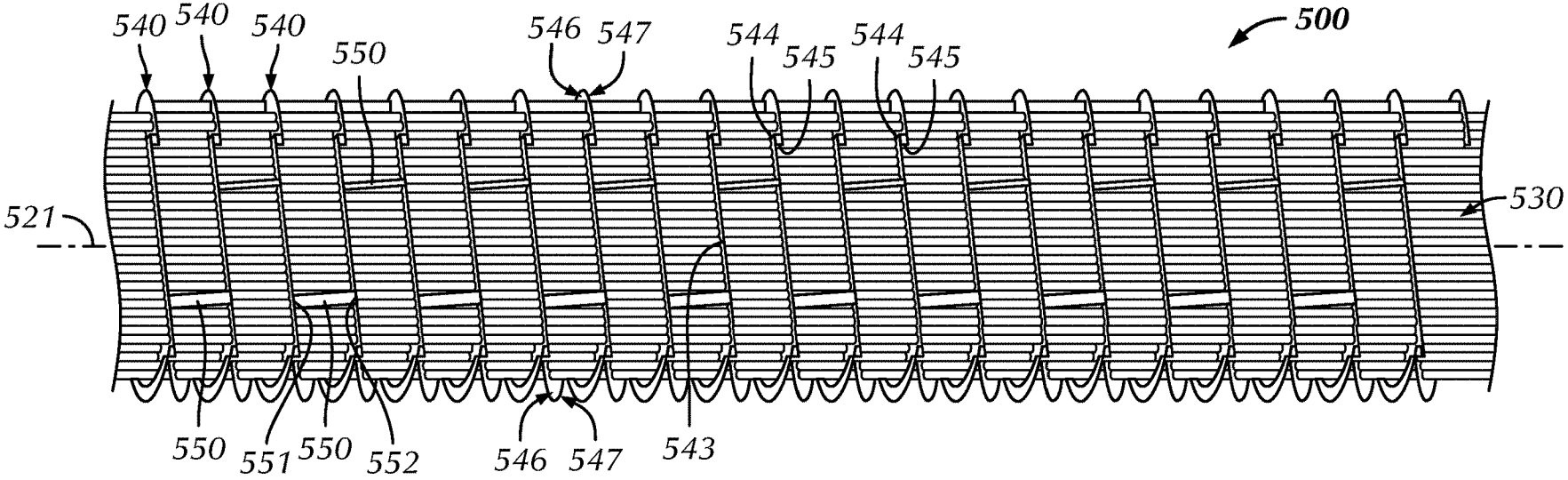
FIGS. 5A-5E illustrate multiple views of a heat exchanger according to one or more embodiments of the present disclosure.
Figure 5B:
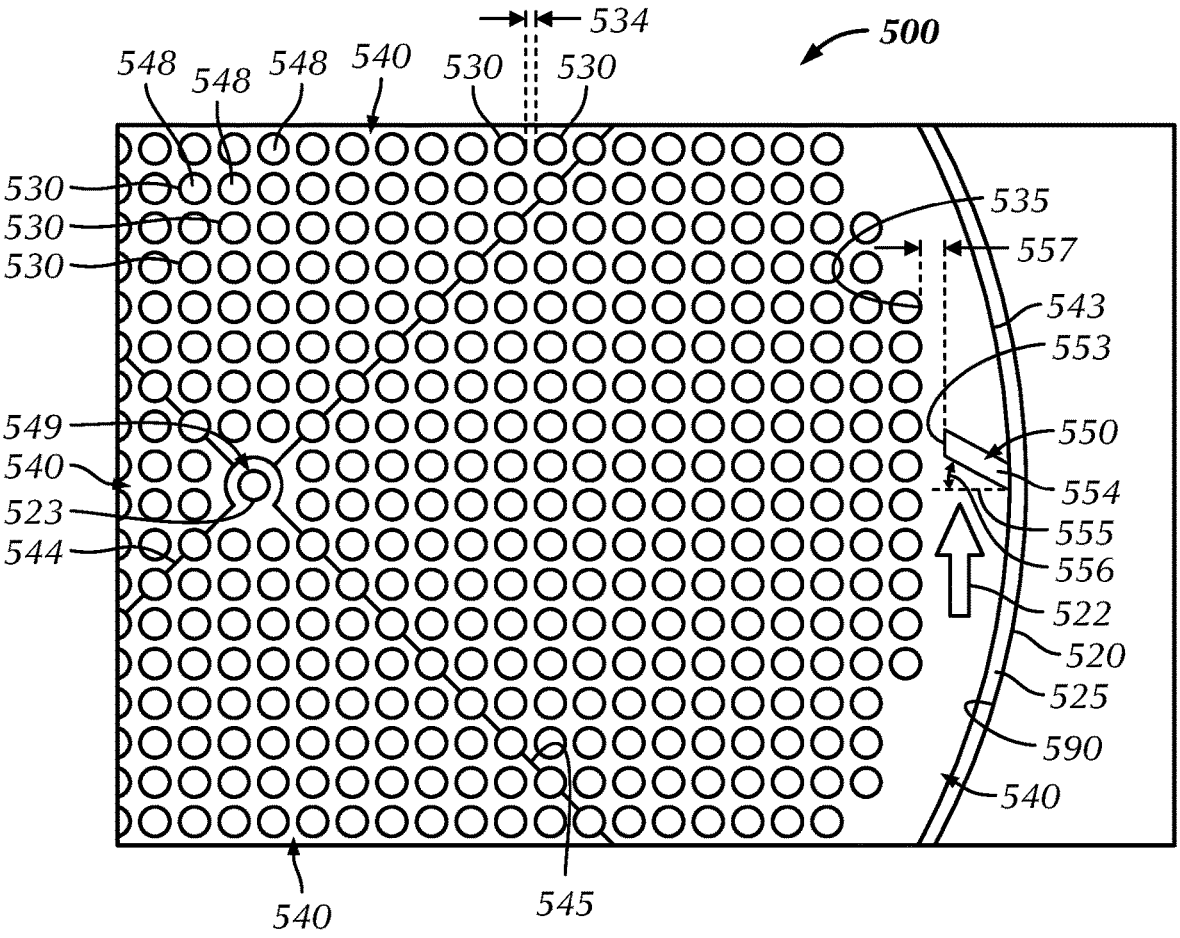

Referring to FIGS. 5A and 5B, in one or more embodiments, the plurality of baffles 540 may be disposed such that successive baffles 540 are positioned at an angle from a line that is normal to a longitudinal axis 521 of the shell 520. In one or more embodiments, the baffles 540 may be coupled to and disposed around a center rod 523, and the successive baffles 540 may be rotationally and longitudinally offset from each other such that a helical pattern is formed. The rotational offset between successive baffles 540 may be such that at least a proximal radial edge 544 of one baffle 540 abuts or overlaps a distal radial edge 545 of an adjacent baffle 540 in a longitudinal direction. In one or more embodiments, a proximal radial edge 544 of each baffle 540 may be the radial edge of the baffle 540 that is axially closest to the inlet of the shell 520 of the heat exchanger 500, and a distal radial edge 545 of each baffle 540 may be the radial edge of the baffle 540 that is axially farthest from the inlet of the shell 520 of the heat exchanger 500. Further, in one or more embodiments, there may be an equal number of baffles 540 per 360° rotation about the longitudinal axis 521 about which the baffles 540 are disposed. For example, in one or more embodiments, there may be four baffles 540 per 360° rotation about the longitudinal axis 521 of the shell 520. While four elliptical sector-shaped baffles per 360° rotation about the longitudinal axis of the shell are shown, in one or more embodiments, any number of baffles of varying shapes per 360° rotation about the longitudinal axis of the shell may be utilized as long as the baffles are longitudinally and rotationally offset such that a helical flow path is formed.

Still referring to FIGS. 5A and 5B, in one or more embodiments, the baffles 540 may be elliptical sector-shaped. Each of the baffles 540 may have an outer circumferential edge 543, and each outer circumferential edge 543 may be spaced apart from the outer circumferential edge 543 of an adjacent baffle 540. Each of the baffles 540 may also include a proximal radial edge 544 at one end of the outer circumferential edge 543 and a distal radial edge 545 at the other end of the outer circumferential edge 543 such that the elliptical sector-shaped baffles 540 are defined by the outer circumferential edge 543, the proximal radial edge 544, and the distal radial edge 545. Furthermore, each of the baffles 540 may have a proximal side 546 and a distal side 547 that are opposite of each other as well as a plurality of spaced apart holes 548 that extend through the baffles 540 from the proximal side 546 to the distal side 547. In one or more embodiments, a proximal side 546 of each baffle 540 may be the side of the baffle 540 that is axially closest to the inlet of the shell 520 of the heat exchanger 500, and a distal side 547 may be the side of each baffle 540 that is axially farthest from the inlet of the shell 520 of the heat exchanger 500.

In one or more embodiments, one tube 530 of the plurality of axially extending tubes 530 may pass through holes 548 in the baffles 540, and a direction of a second fluid flow within the tubes 530 may be opposite to a direction of a first fluid flow from the inlet of the shell to the outlet of the shell. Further, in one or more embodiments, the holes 548 of one baffle 540 may align with holes on another baffle 540 such that the tubes 530 may extend axially along an entire length of a heat exchanger 500 and such that each of the tubes 530 be supported by multiple baffles 540. Furthermore, a distance 534 between outer diameters 535 of each of the tubes 530 that are disposed in each of the holes 548 may be consistent across the entirety of the plurality of tubes 530. Additionally, as discussed above, in one or more embodiments, each of the baffles 540 may include a center hole 549 at an intersection between the first radial edge 544 and the second radial edge 545 through which the center rod 523 may pass in order to couple each of the baffles 540 to the center rod 523. The center hole 549 of each baffle 540 may be uniquely angled such that the baffles 540 are positioned at an angle from the line normal to the longitudinal axis 521 of the shell 520.

Figure 5C:
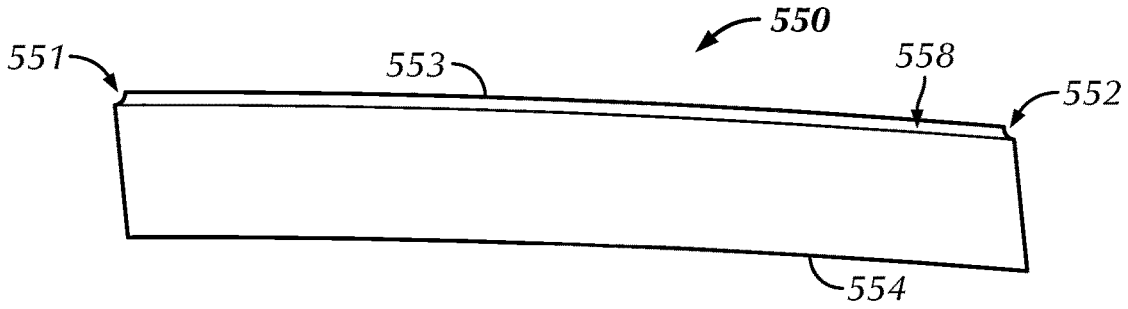
Figure 5D:
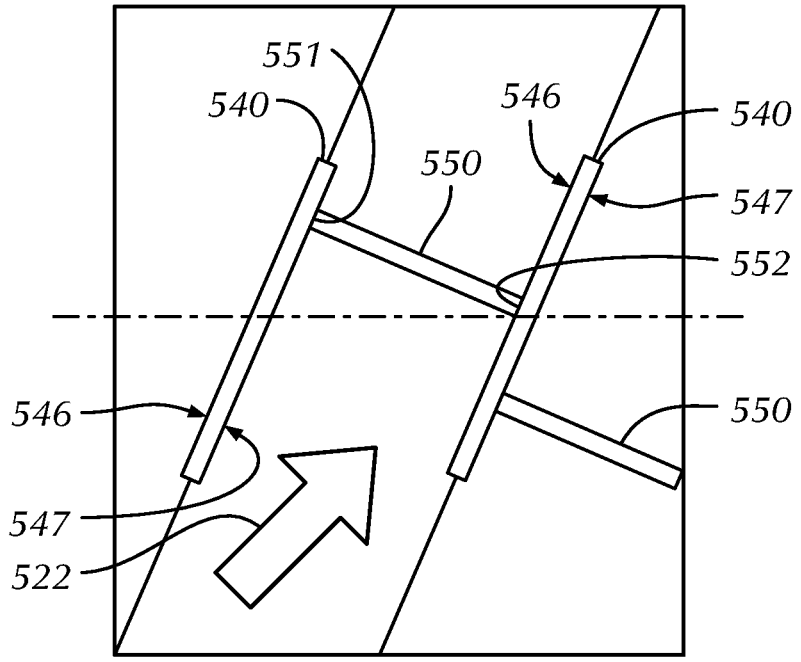
Figure 5E:
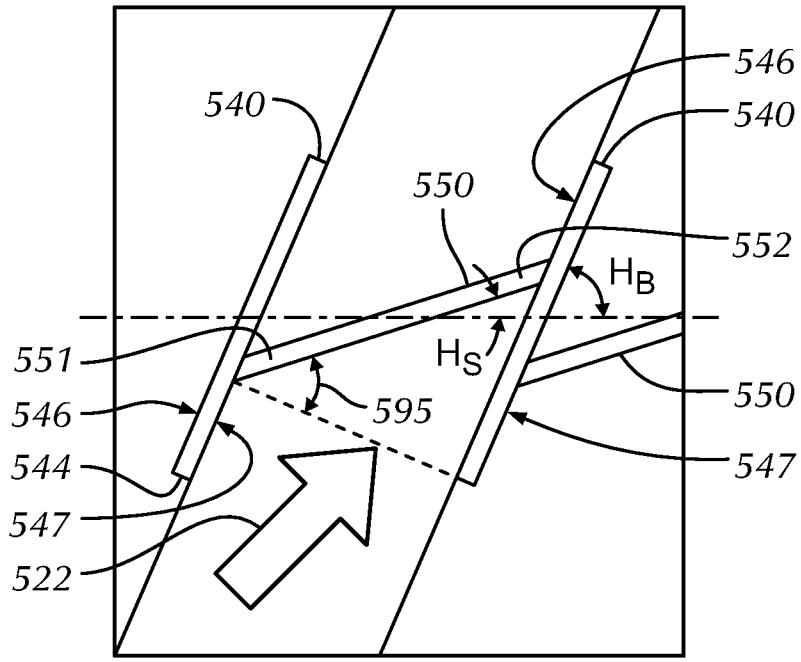

Further, referring to FIGS. 5A-5E, in one or more embodiments, a first plurality of seal strips 550 may each be disposed between a first baffle 540 and a corresponding, successive baffle 540 that is at least a full 360° rotation from the first baffle 540. Further, each of the first plurality of seal strips 550 may be disposed radially between the plurality of tubes 530 and an inner surface 525 of the shell 520. In one or more embodiments, the inner surface 525 may have a diameter 590. Further, in one or more embodiments, each of the first plurality of seal strips 550 may be coupled to each of the first baffle 540 and the corresponding, successive baffle 540. In one or more embodiments, the first plurality of seal strips 550 may be disposed such that each of the first plurality of seal strips 550 are substantially orthogonal to the helical path defined by the baffles within the shell 520 of the heat exchanger 500. Referring to FIGS. 5A, 5D, and 5E, in one or more embodiments, a first end 551 of each of the first plurality of seal strips 550 may be coupled to the distal side 547 of one of the plurality of baffles 540 between the proximal radial edge 544 and the distal radial edge 545, and a second end 552 of each of the first plurality of seal strips 550 may be coupled to the proximal side 546 of another of the plurality of baffles 540 between the proximal radial edge 544 and the distal radial edge 545.

As shown in FIGS. 5A and 5D, in one or more embodiments, each of the first plurality of seal strips 550 may be disposed orthogonal to both the distal side 547 of one baffle 540 and the proximal side 546 of another baffle 540. As shown in FIG. 5E, in other embodiments, each of the plurality of seal strips 550 may be connected between two baffles 540. As illustrated in FIG. 5E, the seal strip 550 may be disposed such that an angle 595 is formed between the seal strip 550 and a line orthogonal to the proximal side 546 of one baffle 540 and the distal side of the other baffle 540. In some embodiments, the angle 595 may be from greater than 0° up to 80°. In further embodiments, the angle 595 may be one of from greater than 0° up to 30°, from 15° up to 45°, from 45° up to 80°, or from 15° up to 30°. Due to the possible leakage of a first fluid between consecutive baffles of the plurality of baffles 540, the direction 522 of the first fluid flow may vary slightly from the helical path formed by the plurality of baffles 540. Further, due to this possible variance in the first fluid flow direction, the angle 595 of the seal strips 550 may vary such that each of the first plurality of seal strips 550 may be orthogonal to the helical first fluid flow direction 522.

As shown in FIGS. 5A and 5B, the baffles 540 may be disposed in four quadrants. In some embodiments, a seal strip 550 may connect a first baffle 540 to a second baffle 540 in the same quadrant (or the same sector where other than four baffles are used per 360° rotation). The seal strip may be connected from the distal side 547 of the first baffle 540 to a proximal side 546 of the second baffle 540, at a point adjacent to the distal edge 545 of the second baffle 540, as described above. For example, the seal strip may connect the distal side 547 of a first baffle 540 from adjacent to the proximal edge 544 of the first baffle to the proximal side 546 of a second baffle adjacent to the distal edge 545 of the second baffle. As another example, the seal strip may connect the distal side 547 of a first baffle 540 from adjacent to the proximal edge 544 of the first baffle to the proximal side 546 of a second baffle adjacent to the proximal edge 544 of the second baffle.

In some embodiments, a seal strip 550 may connect a first baffle 540 to a second baffle 540 in an adjacent quadrant (sector). The seal strip may be connected from the distal side 547 of the first baffle 540 to a proximal side 546 of the second baffle 540, as described above. For example, in some embodiments, the seal strip may connect the distal side 547 of a first baffle 540 from intermediate the proximal edge 544 and distal edge 545 of the first baffle to the proximal side 546 of a second baffle intermediate the proximal edge 544 and distal edge 545 of the second baffle.

In other embodiments, a heat exchanger may include some seal strips 550 that connect between baffles 540 in the same quadrant, while other seal strips 550 may connect between baffles 540 in adjacent quadrants.

In some embodiments, as shown in FIG. 5E, improved heat exchange and reduced pressure drop may be realized where the seal strips may, in part, direct flow helically toward the outlet. In other words, the seal strips 550 may be disposed at a helix angle $H_s$ less than a helix angle $H_B$ of the baffles 540, where the helix angle is defined as the angle of the baffle or seal strip relative to the longitudinal axis of the heat exchanger. In some embodiments, seal strip helix angle $H_s$ may be in the range from greater than 0° to 80°, such as from a lower limit of 5°, 10°, 15°, 20°, 25°, 30°, 35°, 40°, or 45° to an upper limit of 25°, 30°, 40°, 45°, 50°, 60°, 70°, 75°, or 80°, where any lower limit may be combined with any greater upper limit according to embodiments herein. It has been found that in some embodiments, strips that have a helix angle $H_s$ greater than a helix angle $H_B$ of the baffle, while providing better sealing, may disrupt the helical flow path of the fluid (i.e., trying to drive flow back toward the inlet). In contrast, where the seal strips encourage the helical flow, adequate sealing is provided while both reducing pressure drop (relative to a conventional seal) and improving heat transfer results. In various embodiments the baffle angle $H_B$ may be consistent or may vary along the length of the heat exchanger. When varying baffle angles are used, for example, proximal baffles may be disposed at a first angle ($H_{B1}$, not shown) to the longitudinal axis and more distal baffles may be disposed at a second different angle ($H_{B2}$, not shown) to the longitudinal axis. As another example, proximal baffles may be disposed at a first angle to the longitudinal axis and more distal baffles may be successively disposed at increasing or decreasing angles to the longitudinal axis ($H_{B1}<H_{B2}<H_{B3}$ etc.).

As described above, in one or more embodiments, the first plurality of seal strips 550 may be disposed such that each of the first plurality of seal strips 550 are orthogonal or substantially orthogonal to the helical path defined by the baffles within the shell 520 of the heat exchanger 500. In other embodiments, due to leakage and the possible variance in the first fluid flow direction, the angle 595 of the seal strips 550 may vary such that each of the first plurality of seal strips 550 may be orthogonal to the helical first fluid flow direction. While it is desirable for the fluid to flow as close to the geometric lead as possible, it is recognized herein that this is not always the case. Hence the fluid flow path may not be orthogonal to the seal strip 550 as shown. Leakage and the amount of change in the first fluid flow direction may also vary depending upon the properties of the fluid being conveyed and the shell and baffle dimensions. Embodiments herein may thus include estimating a first fluid flow direction, such as by computational fluid dynamics or other simulations or experimental investigations, such that the angle of the strip 550 may be installed accounting for the expected difference between the geometric helical lead and the actual fluid path such that the strip is orthogonal to the flow.

While embodiments shown in FIGS. 5A-5E may include a plurality of seal strips that are all disposed at the same angle between one baffle and another baffle, in one or more embodiments, the seal strips may be disposed at different angles within the heat exchanger. In other words, in one or more embodiments, one seal strip of the plurality of seal strips may be disposed orthogonal to both the distal side of one baffle and the proximal side of another baffle, and another seal strip of the plurality of seal strips may be disposed at an angle from orthogonal to the proximal side of one baffle and the distal side of the other baffle, in which the angle may be from greater than 0° up to 80°. Thus, while in one or more embodiments all of the seal strips may be disposed with the same angular disposition between baffles, in other embodiments, a combination of seal strips of different angular dispositions may be used. Further, while in one or more embodiments seal strips of a first angular disposition may be used between the baffles of the first several rotations about the longitudinal axis and seal strips of a second angular disposition may be used between the baffles of the remaining rotations about the longitudinal axis, in other embodiments, different patterns of seal strips of a first angular disposition and seal strips of a second angular disposition may be used. Furthermore, in one or more embodiments, seal strips of more than two angular dispositions may be used throughout the heat exchanger in different patterns.

Further, referring to FIGS. 5B and 5C, in one or more embodiments, each of the first plurality of seal strips may have a curved inner surface 553 and a curved outer surface 554. In one or more embodiments, the curved outer surface 554 of each seal strip 550 may be disposed substantially proximate the inner surface 525 of the shell 520. Further, in one or more embodiments, the curved outer surface 554 of one or more of the seal strips 550 may have a clearance of 1-5 mm from the inner surface 525 of the shell 520. For example, the curved outer surface 554 of one or more of the seal strips 550 may have a clearance of 3 mm from the inner surface 525 of the shell 520. Additionally, a curvature of the curved outer surface 554 of the seal strips 550 may be elliptical in shape and may match a curvature of the inner surface 525 of the shell 520. While noting that the seal strips may be elliptical, the appearance of the seal strips may vary with angle. For example, where $H_S$ is small, the strips may be nearly straight. In contrast, where $H_S$ is large, the strips will be elliptical. The elliptical shape ensures that each of the space between the shell and the strip and the space between the tube bundle and the strip may be the same along the length of the strip. Further, as the strips are elliptical, the strips may be represented by a minor diameter and a major diameter (not shown), where the shell diameter, spacing from the shell diameter, and the strip angle $H_S$ may define the elliptical nature of the strip.

Furthermore, in one or more embodiments, a curvature of the curved inner surface 553 of each of the first plurality of seal strips 550 may be elliptical in shape and the curvature of the inner surface 553 may be different than the curvature of the outer surface 554 of each of the first plurality of seal strips 550. In other words, in one or more embodiments, the curvature of the inner surface 553 of each seal strip 550 may match a curvature of an imaginary cylinder with a diameter equal to the diameter 590 of the inner surface 525 of the shell 520 minus a radial width of the seal strip 550. Further, the inner surface 553 of each of the first plurality of seal strips 550 may be spaced from the outer diameter 535 of a closest tube 530 of the plurality of axially extending tubes 530 by a distance 557. The distance 557 between the inner surface 553 of the seal strips 550 and the outer diameter 535 of the closest tube 530 may be equal to the distance 534 between the outer diameters 535 of two adjacent tubes 530. Furthermore, the first plurality of seal strips 550 may be angled from the outer surface 554 to the inner surface 553 by an angle 556 from a line 555 orthogonal to the shell 520 in a direction of the first fluid flow 522. For example, in one or more embodiments, each of the first plurality of seal strips 550, which are disposed perpendicularly to the angled baffles 540, may be angled by 15°-45° from a line 555 that is orthogonal to the shell 520 such that the first fluid flow 522 contacts the seal strip at a 105°-135° angle and deflects back towards the plurality of tubes 530. Further, the first plurality of seal strips 550 may have a thickness 558, and a larger thickness 558 may be used for a heat exchanger 500 with a larger diameter 590 of the inner surface 525 of the shell 520.

Each of the first plurality of seal strips 550, as described for some embodiments herein, may have a curved outer diameter with a curvature that is elliptical and/or wherein each of the first plurality of seal strips have a curved inner diameter with a curvature that is elliptical. In other embodiments, the seal strips 550 may be wider in regions where the bundle-to-shell gap is larger. As the grid layout of the holes through the baffles may not result in a circular pattern for the outermost holes, a seal strip that may vary in width may provide better sealing. In some embodiments, the width may be achieved by varying an elliptical curvature of each of the inner and outer diameters of the seal strips. In other embodiments, the width may be varied systematically, such as to match a profile gap or provide a consistent profile gap between the inner diameter of the seal strips to each of the respective tubes. Similarly, a depth of the seal strips may be varied. Thus, in various embodiments, each of the first plurality of seal strips may have a width, outer diameter minus inner diameter, that varies along a length, first end to second end, of the seal strip, and/or each of the first plurality of seal strips may have a depth, proximal side to distal side, that varies along the width or the length of the seal strip Additionally, in one or more embodiments, a number of the first plurality of seal strips 550 per 360° rotation about the longitudinal axis 521 may be a multiple of a number of baffles per 360° rotation about the longitudinal axis 521. Further, a number of the first plurality of seal strips 550 disposed between a baffle 540 and a corresponding, successive baffle 540 that is a full 360° rotation from the baffle 540 may be equal for all baffles 540 in the plurality of baffles 540. For example, in one or more embodiments, there may be four baffles 540 per 360° rotation about the longitudinal axis 521, and there may be four of the first plurality of seal strips 550 per 360° rotation about the longitudinal axis 521 such that there is one of the first plurality of seal strips 550 per baffle 540 per 360° rotation about the longitudinal axis 521. In other embodiments, there may be four baffles 540 per 360° rotation about the longitudinal axis 521, and there may be eight of the first plurality of seal strips 550 per 360° rotation about the longitudinal axis 521 such that there are two of the first plurality of seal strips 550 per baffle 540 per 360° rotation about the longitudinal axis 521. The number of the first plurality of seal strips 550 per 360° rotation about the longitudinal axis 521 may be dependent on the size of the inner surface 525 of the shell 520, the number of the plurality of tubes 530 disposed within the heat exchanger, and the distance 534 between the outer diameters 535 of the plurality of tubes 530. In one or more embodiments, there may be one of the first plurality of seal strips 550 disposed within the shell 520 for every eight to ten rows of the plurality of tubes 530 disposed within the heat exchanger 500.

Furthermore, referring to FIG. 5A, in one or more embodiments, at least one of the first plurality of seal strips 550 may be coupled to a proximal side 546 of the baffle 540 and at least one of the first plurality of seal strips 550 may be coupled to a distal side 547 of the baffle 540. Additionally, in one or more embodiments, each of the first plurality of seal strips 550 that is coupled to the distal side 547 of each of the plurality of baffles 540 may be offset rotationally about the longitudinal axis 521 of the shell 520 from each of the first plurality of seal strips 550 that is coupled to the proximal side 546 of each of the plurality of baffles 540. In one or more embodiments, the rotationally offset seal strips 550 may follow a predetermined pattern along an entire length of the heat exchanger 500. Further, while rotationally offset adjacent seal strips 550 are shown in FIG. 5A, in one or more embodiments, the adjacent seal strips 550 may be longitudinally aligned along an entire length of the heat exchanger. Additionally, in one or more embodiments, the first plurality of seal strips 550 may be formed of steel.

In yet other embodiments, the first plurality of seal strips 550 may be disposed such that each of the first plurality of seal strips 550 are substantially parallel (substantially parallel being +/−1° or another small manufacturing tolerance) to a longitudinal axis of the heat exchanger. When parallel to the longitudinal axis, each seal strip should be connected to a proximal baffle 540 and a longitudinally adjacent distal baffle 540. As compared to the prior practice of including a hole for the seal strip in each baffle plate and using a single, long seal strip from one end of the exchanger to the other, it has been found that individual seal strips between longitudinally adjacent baffles provides for both better sealing and a reduced pressure drop. In some embodiments, the seal strips connected to longitudinally adjacent baffles may be circumferentially offset. For example, each of the plurality of baffles may be connected to at least two seal strips 550, including a distal seal strip 550 connected to a distal side of a baffle, and a proximal seal strip 550 connected to a proximal side of the same baffle, where the proximal seal strip is circumferentially offset from the distal seal strip. In some embodiments, the circumferential offset may be at least 10°, at least 15°, or at least 20°, but necessarily offset by less than the total number of degrees of the respective elliptical sector of the sector shaped baffle. The rotationally or circumferentially offset seal strips may thus include one, two or more seal strips connected to a proximal side of a baffle as well as one, two or more seal strips connected to a distal side of a baffle, where the number of seal strips connected to the distal and proximal sides may be equal in some sectors and unequal in others. In some embodiments, an equal number of seal strips may be coupled to each baffle of the plurality of baffles. In other embodiments, a seal strip may not be coupled to every baffle of the plurality of baffles. For instance, where four baffles are used per 360° rotation, including quadrants A, B, C, and D, seal strips may only be used in quadrants A and C or B and D, for example; in other embodiments, seal strips may be used, for instance, every three quadrants (successively A, D, C, B, A . . . ). The number and placement of seal strips may depend upon the sealing and structural requirements of a particular heat exchanger.

Referring now to FIGS. 6A-6D, portions of heat exchangers 600 according to several embodiments of the present disclosure are shown. As discussed above with regard to FIGS. 5A-5E, in one or more embodiments, a heat exchanger 600 may include a plurality of elliptical sector-shaped baffles 640 and a first plurality of seal strips 650 disposed between the baffles 640. The first plurality of seal strips 650 may each be disposed between a first baffle 640 and a corresponding, successive baffle 640 that is a full 360° rotation from the first baffle 640. Further, a first end 651 of each of the first plurality of seal strips 650 may be coupled to a distal side 647 of one of the plurality of baffles 640 between a proximal radial edge 644 and a distal radial edge 645, and a second end 652 of each of the first plurality of seal strips 650 may be coupled to a proximal side 646 of another of the plurality of baffles 640 between the proximal radial edge 644 and the distal radial edge 645. In one or more embodiments, the proximal radial edge 644 of each baffle 640 may be the radial edge of the baffle 640 that is closest to an inlet of a shell of the heat exchanger 600, and the distal radial edge 645 of each baffle 640 may be the radial edge of the baffle 640 that is farthest from the inlet of the shell of the heat exchanger 600. Similarly, in one or more embodiments, the proximal side 646 of each baffle 640 may be the side of the baffle 640 that is closest to the inlet of the shell of the heat exchanger 600, and the distal side 647 may be the side of each baffle 640 that is farthest from the inlet of the shell of the heat exchanger 600.

Figure 6A:
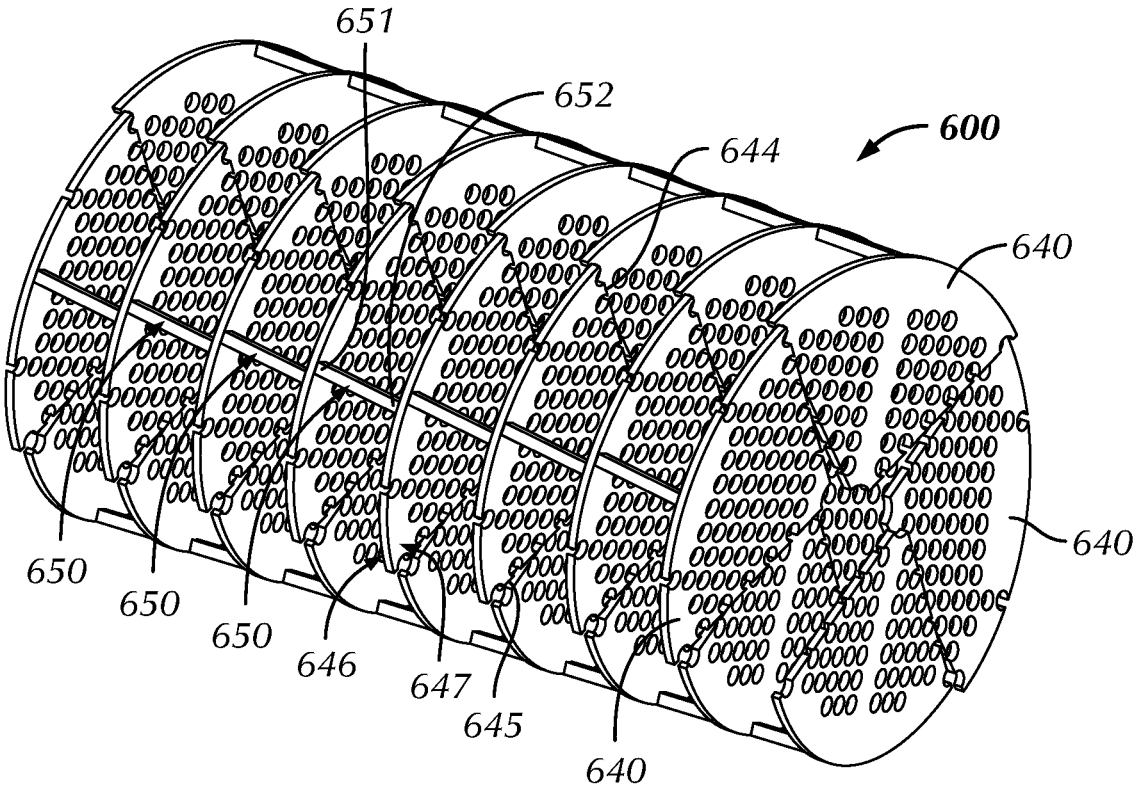
FIGS. 6A-6D illustrate perspective views of heat exchangers according to multiple embodiments of the present disclosure.

Referring to FIG. 6A, in one or more embodiments, each of the first plurality of seal strips 650 may be disposed orthogonal to both the distal side 647 of one baffle 640 and the proximal side 646 of another baffle 640. In other embodiments, each of the plurality of seal strips 650 may be disposed at an angle (not shown) from orthogonal to the proximal side 646 of one baffle 640 and the distal side 647 of the other baffle 640, and the angle may be from greater than 0° up to 80°.

Figure 6B:
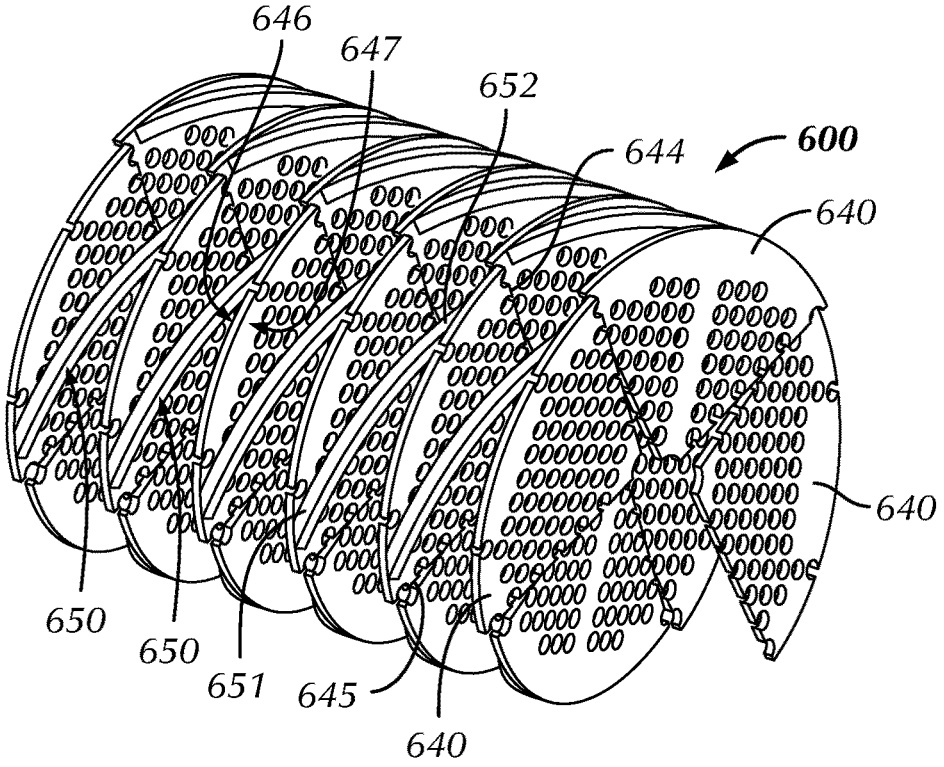

Referring to FIG. 6B by way of example only, seal strips 650 may be connected between a first baffle 640 and a second baffle 640 in the same quadrant. Each of the plurality of seal strips may be disposed at an angle from orthogonal to the proximal side 646 of the first baffle 640, and the angle may be from greater than 45° up to 80° in a direction defined from the distal radial edge 645 to the proximal radial edge 644 of the second baffle 640. Further, as discussed above, in other embodiments, the angle may be one of from greater than 0° up to 30°, from 15° up to 45°, or from 15° up to 30°. Due to the possible leakage of a first fluid between consecutive baffles of the plurality of baffles 640, the direction of the first fluid flow may vary slightly from the helical path formed by the plurality of baffles 640. Further, due to this possible variance in the first fluid flow direction, the angle of the seal strips 650 may vary such that each of the first plurality of seal strips 650 may be orthogonal to the helical first fluid flow direction.

Figure 6C:
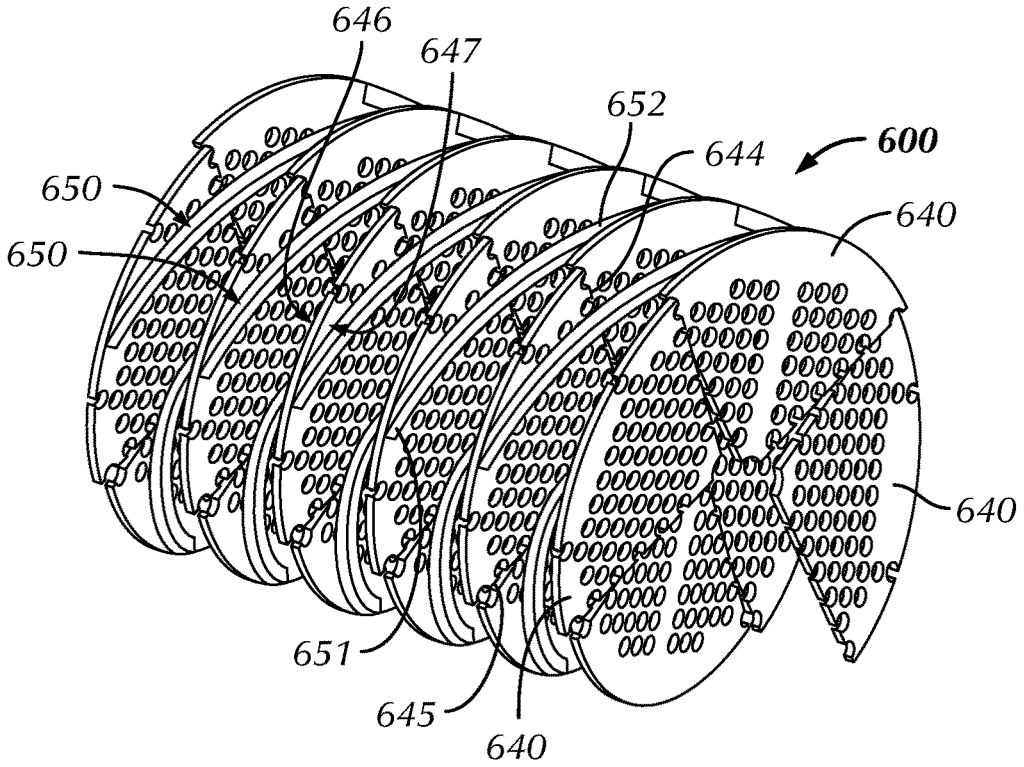
Figure 6D:
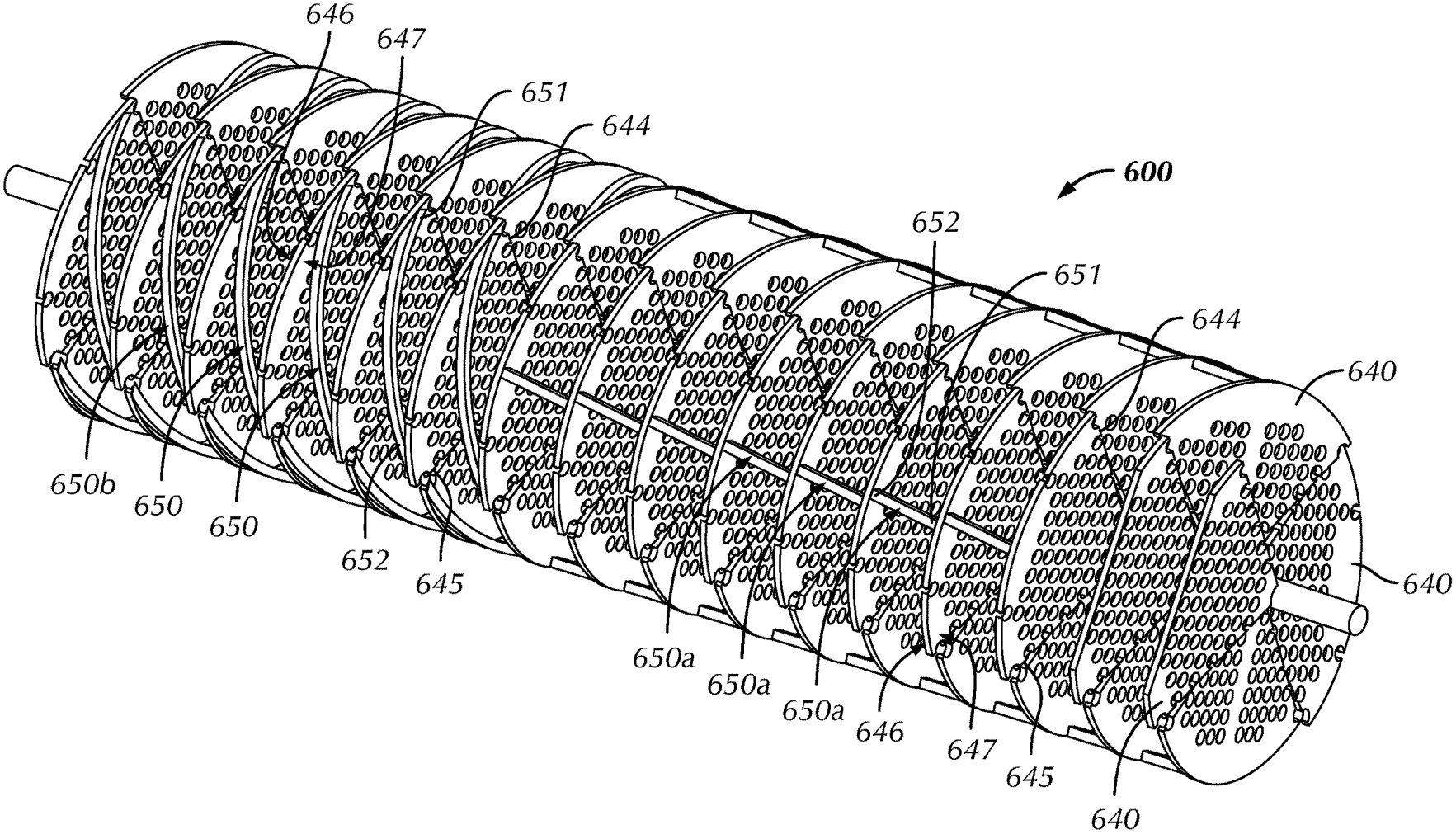

Referring to FIG. 6C by way of example only, seal strips 650 may be connected between a first baffle 640 in a first quadrant and a second baffle 640 in an adjacent quadrant. Each of the plurality of seal strips may be disposed at an angle from orthogonal to the proximal side 646 of the first baffle 640, and the angle may be from greater than 45° up to 80° in a direction defined from the distal radial edge 645 to the proximal radial edge 644 of the second baffle 640. Further, as discussed above, in other embodiments, the angle may be one of from greater than 0° up to 30°, from 15° up to 45°, or from 15° up to 30° in a direction defined from the distal radial edge 645 to the proximal radial edge 644 of the second baffle 640. Due to the possible leakage of a first fluid between consecutive baffles of the plurality of baffles 640, the direction of the first fluid flow may vary slightly from the helical path formed by the plurality of baffles 640. Further, due to this possible variance in the first fluid flow direction, the angle of the seal strips 650 may vary such that each of the first plurality of seal strips 650 may be orthogonal to the helical first fluid flow direction.

In some embodiments, some seal strips 650 may be connected between baffles 640 in the same quadrant, as illustrated in FIG. 6B, while other seal strips 650 may be connected between baffles 640 in adjacent quadrants, as illustrated in FIG. 6C.

While embodiments shown in FIGS. 6A-6C may include a plurality of seal strips 650 that are all disposed at the same angle between one baffle 640 and another baffle 640, referring to FIG. 6C, in one or more embodiments, the seal strips 650 may be disposed at different angles (not shown) within the heat exchanger. In other words, referring to FIG. 6C, in one or more embodiments, one seal strip 650*a* of the plurality of seal strips 650 may be disposed orthogonal to both the distal side 647 of one baffle 640 and the proximal side 646 of another baffle 640, and another seal strip 650*b* of the plurality of seal strips 650 may be disposed at an angle from orthogonal to the proximal side 646 of one baffle 640 and the distal side 647 of the other baffle 640 in which the angle may be from greater than 0° up to 80°. Thus, while in one or more embodiments, all of the seal strips 650 may be disposed between baffles with the same angular disposition, in other embodiments, a combination of seal strips 650 of different angular dispositions may be used. Further, while in one or more embodiments, seal strips 650*a* of a first angular disposition may be used between the baffles 640 of the first several rotations about the longitudinal axis and seal strips 650*b* of a second angular disposition may be used between the baffles 640 of the remaining rotations about the longitudinal axis, in other embodiments, different patterns of seal strips 650*a* of a first angular disposition and seal strips 650*b* of a second angular disposition may be used. Furthermore, in one or more embodiments, seal strips of more than two angular dispositions may be used throughout the heat exchanger in different patterns. In some embodiments, both the angular dispositions of the seal strips and the quadrants between which the seal strips are arranged may vary within a heat exchanger.

Figure 7:
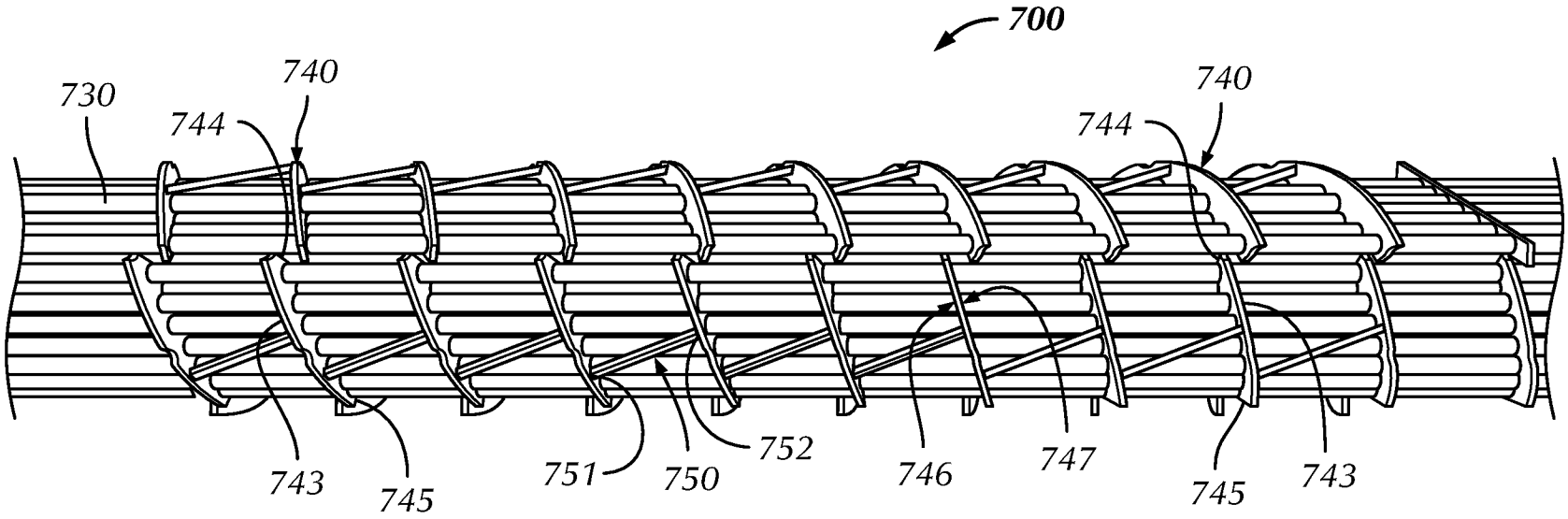
FIG. 7 illustrates a side view of a heat exchanger according to one or more embodiments of the present disclosure.

Referring now to FIG. 7, a portion of a heat exchanger 700 according to one or more embodiments of the present disclosure is shown. In one or more embodiments, a heat exchanger 700 may include a shell (not shown) through which a first fluid is passed, a plurality of axially extending tubes 730 through which a second fluid is passed, a plurality of elliptical sector-shaped baffles 740, and a first plurality of seal strips 750 disposed between the baffles 740. The shell may include an inlet (not shown) and an outlet (not shown) between which the first fluid may pass within the shell. Further, the plurality of tubes 730, the plurality of baffles 740, and the first plurality of seal strips 750 may be disposed within the shell.

Referring to FIG. 7, similar to heat exchangers discussed above, in one or more embodiments, the plurality of baffles 740 may be disposed such that successive baffles 740 are positioned at an angle from a line that is normal to a longitudinal axis (not shown) of the shell. In one or more embodiments, the baffles 740 may be coupled about the longitudinal axis, and the successive baffles 740 may be rotationally and longitudinally offset from each other such that a helical pattern is formed. The rotational offset between successive baffles 740 may be such that at least a proximal radial edge 744 of one baffle 740 overlaps a distal radial edge 745 of an adjacent baffle 740 in a longitudinal direction. In one or more embodiments, the proximal radial edge 744 of each baffle 740 may be the radial edge of the baffle 740 that is closest to the inlet of the shell of the heat exchanger 700, and the distal radial edge 745 of each baffle 740 may be the radial edge of the baffle 740 that is farthest from the inlet of the shell of the heat exchanger 700. Further, as discussed above, in one or more embodiments, there may be an equal number of baffles 740 per 360° rotation about the longitudinal axis about which the baffles 740 are disposed.

Still referring to FIG. 7, in one or more embodiments, the baffles 740 may be elliptical sector-shaped. Each of the baffles 740 may have an outer circumferential edge 743, and each outer circumferential edge 743 may be spaced apart from the outer circumferential edge 743 of an adjacent baffle 740. Each of the baffles 740 may also include the proximal radial edge 744 at one end of the outer circumferential edge 743 and the distal radial edge 745 at the other end of the outer circumferential edge 743 such that the elliptical sector-shaped baffles 740 are defined by the outer circumferential edge 743, the proximal radial edge 744, and the distal radial edge 745. Furthermore, each of the baffles 740 may have a proximal side 746 and a distal side 747 that are opposite of each other as well as a plurality of spaced apart holes (not shown) that extend through the baffles 740 from the proximal side 746 to the distal side 747. In one or more embodiments, the proximal side 746 of each baffle 740 may be the side of the baffle 740 that is closest to the inlet of the shell of the heat exchanger 700, and the distal side 747 may be the side of each baffle 740 that is farthest from the inlet of the shell of the heat exchanger 700. Further, in one or more embodiments, one tube 730 of the plurality of axially extending tubes 730 may pass through holes in the baffles 740. Therefore, as discussed above, the plurality of tubes 730 may extend axially along an entire length of a heat exchanger 700, and each of the tubes 730 may be supported by multiple baffles 740 spaced equally along a length of the tube 730. Furthermore, a distance between outer diameters of each of the tubes 730 that are disposed in each of the holes may be consistent across the entirety of the plurality of tubes 730.

Further, referring to FIG. 7, in one or more embodiments, a first plurality of seal strips 750 may each be disposed between a first baffle 740 and a corresponding, successive baffle 740 that is a full 360° rotation from the first baffle 740. Furthermore, each of the first plurality of seal strips 750 may be disposed radially between the plurality of tubes 730 and a diameter of an inner surface of the shell. As discussed above, in one or more embodiments, each of the first plurality of seal strips 750 may be coupled to each of the first baffle 740 and the corresponding, successive baffle 740. In one or more embodiments, the first plurality of seal strips 750 may be disposed such that each of the first plurality of seal strips 750 are orthogonal to the helical first fluid flow direction within the shell of the heat exchanger 700. Further, in one or more embodiments, a first end 751 of each of the first plurality of seal strips 750 may be coupled to the distal side 747 of one of the plurality of baffles 740 between the proximal radial edge 744 and the distal radial edge 745, and a second end 752 of each of the first plurality of seal strips 750 may be coupled to the proximal side 746 of another of the plurality of baffles 740 between the proximal radial edge 744 and the distal radial edge 745.

As discussed above, in one or more embodiments, each of the first plurality of seal strips 750 may be disposed orthogonal to both the distal side 747 of one baffle 740 and the proximal side 746 of another baffle 740. Further, in other embodiments, each of the plurality of seal strips 750 may be disposed at an angle (not shown) from orthogonal to the proximal side 746 of one baffle 740 and the distal side 747 of the other baffle 740; the angle may be from greater than 0° up to 80°. In further embodiments, the angle may be one of from greater than 0° up to 30°, from 15° up to 45°, from 45° up to 80°, or from 15° up to 30°. Due to the possible leakage of a first fluid between consecutive baffles of the plurality of baffles 740, the direction of the first fluid flow may vary slightly from the helical path formed by the plurality of baffles 740. Further, due to this possible variance in the first fluid flow direction, the angle of the seal strips 750 may vary such that each of the first plurality of seal strips 750 may be orthogonal to the helical first fluid flow direction. The baffles 740 may be arranged in quadrants. In some embodiments, seal strips 750 may be connected between baffles 740 located in the same quadrant. In some embodiments, seal strips 750 may be connected between baffles 740 located in adjacent quadrants. In some embodiments, seal strips 750 may be connected between both baffles 740 located in the same quadrant and baffles 740 located in adjacent quadrants.

Furthermore, referring to FIG. 7, in one or more embodiments, each of the first plurality of seal strips 750 may have a substantially similar structure to the first plurality of seal strips as described above with regard to FIGS. 5A-5E and 6A-6D. Therefore, the first plurality of seal strips 750 may have a curved inner surface and a curved outer surface. In one or more embodiments, the curved outer surface of each seal strip 750 may be disposed substantially proximate the inner surface of the shell. Further, in one or more embodiments, the curved outer surface of one or more of the seal strips 750 may contact the inner surface of the shell. Additionally, a curvature of the curved outer surface of the seal strips 750 may be elliptical in shape and may match a curvature of the inner surface of the shell.

Furthermore, in one or more embodiments, a curvature of the curved inner surface of each of the first plurality of seal strips 750 may be elliptical in shape and the curvature of the inner surface may be different than the curvature of the outer surface of each of the first plurality of seal strips 750. In other words, in one or more embodiments, the curvature of the inner surface of each seal strip 750 may match a curvature of an imaginary cylinder with a diameter equal to the diameter of the inner surface of the shell minus a radial width of the seal strip 750. Further, the inner surface of each of the first plurality of seal strips 750 may be spaced from the outer diameter of a closest tube 730 of the plurality of axially extending tubes 730 by a distance. The distance between the inner surface of the seal strips 750 and the outer diameter of the closest tube 730 may be equal to the distance between the outer diameters of two adjacent tubes 730. Furthermore, in one or more embodiments, the first plurality of seal strips 750 may be angled from the outer surface to the inner surface by an angle from a line orthogonal to the shell in a direction of the first fluid flow. Further, the first plurality of seal strips 750 may have a thickness that varies depending on the diameter of the inner surface of the shell.

Still referring to FIG. 7, in one or more embodiments, at least one of the first plurality of seal strips 750 may be coupled to a proximal side 746 of the baffle 740 and at least one of the first plurality of seal strips 750 may be coupled to a distal side 747 of the baffle 740. Additionally, in one or more embodiments, each of the first plurality of seal strips 750 that is coupled to the distal side 747 of each of the plurality of baffles 740 may be longitudinally aligned with each of the first plurality of seal strips 750 that is coupled to the proximal side 746 of each of the plurality of baffles 740 in a direction that is parallel to the longitudinal axis of the shell of the heat exchanger 700. As discussed above, in one or more embodiments, a number of the first plurality of seal strips 750 disposed between a baffle 740 and a corresponding, successive baffle 740 that is a full 360° rotation from the baffle 740 may be equal for all baffles 740 in the plurality of baffles 740, and thus, a number of the first plurality of seal strips 750 per 360° rotation about the longitudinal axis may be a multiple of the number of baffles 740 per 360° rotation about the longitudinal axis.

Figure 8:
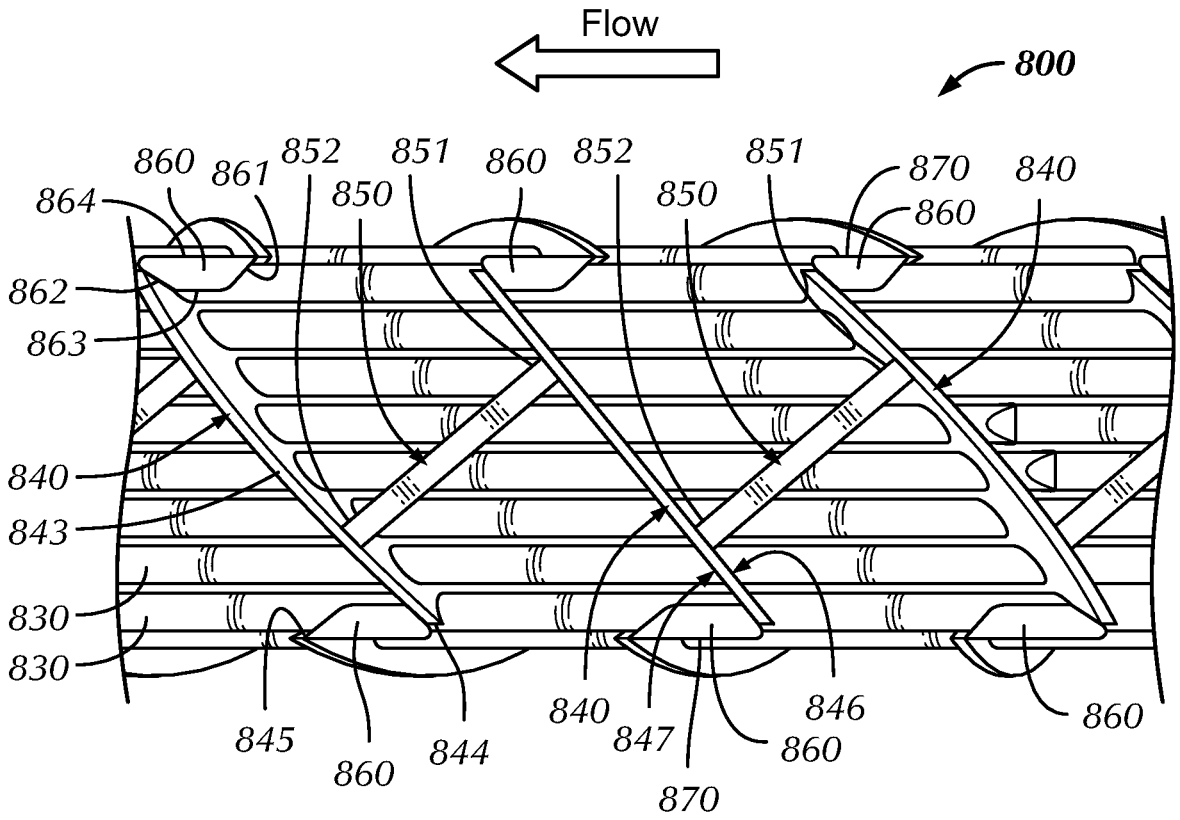
FIG. 8 illustrates a side view of a heat exchanger according to one or more embodiments of the present disclosure.

Referring now to FIG. 8, a portion of a heat exchanger 800 according to one or more embodiments of the present disclosure is shown. In one or more embodiments, a heat exchanger 800 may include a shell (not shown) through which a first fluid is passed, a plurality of axially extending tubes 830 through which a second fluid is passed, a plurality of elliptical sector-shaped baffles 840, a first plurality of seal strips 850 disposed between the baffles 840, and a second plurality of seal strips 860 disposed between the baffles 840. The shell may include an inlet (not shown) and an outlet (not shown) between which the first fluid may pass within the shell. Further, the plurality of tubes 830, the plurality of baffles 840, the first plurality of seal strips 850, and the second plurality of seal strips 860 may be disposed within the shell.

Still referring to FIG. 8, similar to heat exchangers discussed above, in one or more embodiments, the plurality of baffles 840 may be disposed such that successive baffles 840 are positioned at an angle from a line that is normal to a longitudinal axis (not shown) of the shell. In one or more embodiments, the baffles 840 may be coupled about the longitudinal axis, and the successive baffles 840 may be rotationally and longitudinally offset from each other such that a helical pattern is formed. The rotational offset between successive baffles 840 may be such that at least a proximal radial edge 844 of one baffle 840 overlaps a distal radial edge 845 of an adjacent baffle 840 in a longitudinal direction. Further, the longitudinal offset of the overlapping proximal radial edge 844 and distal radial edge 845 between successive baffles 840 may create a gap 870 between the proximal radial edge 844 and the distal radial edge 845 through which a first fluid flow may be able to travel. In one or more embodiments, the proximal radial edge 844 of each baffle 840 may be the radial edge of the baffle 840 that is closest to the inlet of the shell of the heat exchanger 800, and the distal radial edge 845 of each baffle 840 may be the radial edge of the baffle 840 that is farthest from the inlet of the shell of the heat exchanger 800. Further, as discussed above, in one or more embodiments, there may be an equal number of baffles 840 per 360° rotation about the longitudinal axis about which the baffles 840 are disposed.

Further, referring to FIG. 8, in one or more embodiments, the baffles 840 may be elliptical sector-shaped. Each of the baffles 840 may have an outer circumferential edge 843, and each outer circumferential edge 843 may be spaced apart from the outer circumferential edge 843 of an adjacent baffle 840. Each of the baffles 840 may also include the proximal radial edge 844 at one end of the outer circumferential edge 843 and the distal radial edge 845 at the other end of the outer circumferential edge 843 such that the elliptical sector-shaped baffles 840 are defined by the outer circumferential edge 843, the proximal radial edge 844, and the distal radial edge 845. Furthermore, each of the baffles 840 may have a proximal side 846 and a distal side 847 that are opposite of each other as well as a plurality of spaced apart holes (not shown) that extend through the baffles 840 from the proximal side 846 to the distal side 847. In one or more embodiments, the proximal side 846 of each baffle 840 may be the side of the baffle 840 that is closest to the inlet of the shell of the heat exchanger 800, and the distal side 847 may be the side of each baffle 840 that is farthest from the inlet of the shell of the heat exchanger 800. Further, in one or more embodiments, one tube 830 of the plurality of axially extending tubes 830 may pass through each of the holes in the baffles 840. Therefore, as discussed above, the plurality of tubes 830 may extend axially along an entire length of a heat exchanger 800, and each of the tubes 830 may be supported by multiple baffles 840 spaced equally along a length of the tube 830. Furthermore, a distance between outer diameters of each of the tubes 830 that are disposed in each of the holes may be consistent across the entirety of the plurality of tubes 830.

Furthermore, referring to FIG. 8, in one or more embodiments, a first plurality of seal strips 850 may each be disposed between a first baffle 840 and a corresponding, successive baffle 840 that is a full 360° rotation from the first baffle 840. Furthermore, each of the first plurality of seal strips 850 may be disposed radially between the plurality of tubes 830 and a diameter of an inner surface of the shell. As discussed above, in one or more embodiments, each of the first plurality of seal strips 850 may be coupled to each of the first baffle 840 and the corresponding, successive baffle 840. In one or more embodiments, the first plurality of seal strips 850 may be disposed such that each of the first plurality of seal strips 850 is orthogonal to the helical first fluid flow direction within the shell of the heat exchanger 800. Further, in one or more embodiments, a first end 851 of each of the first plurality of seal strips 850 is coupled to the distal side 847 of one of the plurality of baffles 840 between the proximal radial edge 844 and the distal radial edge 845, and a second end 852 of each of the first plurality of seal strips 850 is coupled to the proximal side 846 of another of the plurality of baffles 840 between the proximal radial edge 844 and the distal radial edge 845.

As discussed above, in one or more embodiments, each of the first plurality of seal strips 850 may be disposed orthogonal to both the distal side 847 of one baffle 840 and the proximal side 846 of another baffle 840. Further, in other embodiments, each of the plurality of seal strips 850 may be disposed at an angle (not shown) from orthogonal to the proximal side 846 of one baffle 840 and the distal side 847 of another baffle 850; the angle may be from greater than 0° up to 80°. In further embodiments, the angle may be one of from greater than 0° up to 30°, from 15° up to 45°, from 45° up to 80°, or from 15° up to 30°. Due to the possible leakage of a first fluid between consecutive baffles of the plurality of baffles 840, the direction of the first fluid flow may vary slightly from the helical path formed by the plurality of baffles 840. Further, due to this possible variance in the first fluid flow direction, the angle of the seal strips 850 may vary such that each of the first plurality of seal strips 850 may be orthogonal to the helical first fluid flow direction.

The baffles 740 may be arranged in quadrants. In some embodiments, seal strips 750 may be connected between baffles 740 located in the same quadrant. In some embodiments, seal strips 750 may be connected between baffles 740 located in adjacent quadrants. In some embodiments, seal strips 750 may be connected between both baffles 740 located in the same quadrant and baffles 740 located in adjacent quadrants.

Additionally, referring to FIG. 8, in one or more embodiments, each of the first plurality of seal strips 850 may have a substantially similar structure to the first plurality of seal strips as described above with regard to FIGS. 5A-7. Therefore, the first plurality of seal strips 850 may have a curved inner surface and a curved outer surface. Further, in one or more embodiments, at least one of the first plurality of seal strips 850 may be coupled to a proximal side 846 of the baffle 840 and at least one of the first plurality of seal strips 850 may be coupled to a distal side 847 of the baffle 840. Additionally, in one or more embodiments, each of the first plurality of seal strips 850 that is coupled to the distal side 847 of each of the plurality of baffles 840 may be longitudinally aligned with each of the first plurality of seal strips 850 that is coupled to the proximal side 846 of each of the plurality of baffles 840 in a direction that is parallel to the longitudinal axis of the shell of the heat exchanger 800. Further, as discussed above, in one or more embodiments, a number of the first plurality of seal strips 850 disposed between a baffle 840 and a corresponding, successive baffle 840 that is a full 360° rotation from the baffle 840 may be equal for all baffles 840 in the plurality of baffles 840, and thus, a number of the first plurality of seal strips 850 per 360° rotation about the longitudinal axis may be a multiple of the number of baffles per 360° rotation about the longitudinal axis.

Still referring to FIG. 8, each of a second plurality of seal strips 860 may be disposed between one of the baffles 840 and a successive baffle 840 within the gap 870 formed between the proximal side 846 of the one of the baffles 840 and the distal side 847 of the successive baffle 840 in a region in which the distal radial edge 845 of the one of the baffles 840 overlaps with the proximal radial edge 844 of the successive baffle 840. Further, each of the second plurality of seal strips 860 may be coupled to the baffles 840 in a direction that is parallel to the longitudinal axis of the shell of the heat exchanger 800, and the second plurality of seal strips 860 may be disposed radially between the shell and the plurality of tubes 830. Furthermore, each of the second plurality of seal strips 860 may have a first end 861 that may be coupled proximate to the proximal radial edge 844 of the distal side 847 of one of the plurality of baffles 840 and a second end 862 that may be coupled proximate to the distal radial edge 845 of the proximal side 846 of another of the plurality of baffles. Additionally, in one or more embodiments, each of the second plurality of seal strips 860 may be trapezoidal-shaped with an inner surface 863 and an outer surface 864. The inner surface 863 of each of the second plurality of seal strips 860 may be spaced from an outer diameter of a closest tube 830 of the plurality of axially extending tubes 830 by a distance that may be equal to the distance between outer diameters of two adjacent tubes 830 of the plurality of axially extending tubes 830. Further, in one or more embodiments, a number of the second plurality of seal strips 860 disposed between a baffle 840 and a successive baffle 840 in the gap 870 formed by the region of overlap between the baffles 840 may be equal to the number of baffles per 360° rotation about the longitudinal axis.

Figure 9:
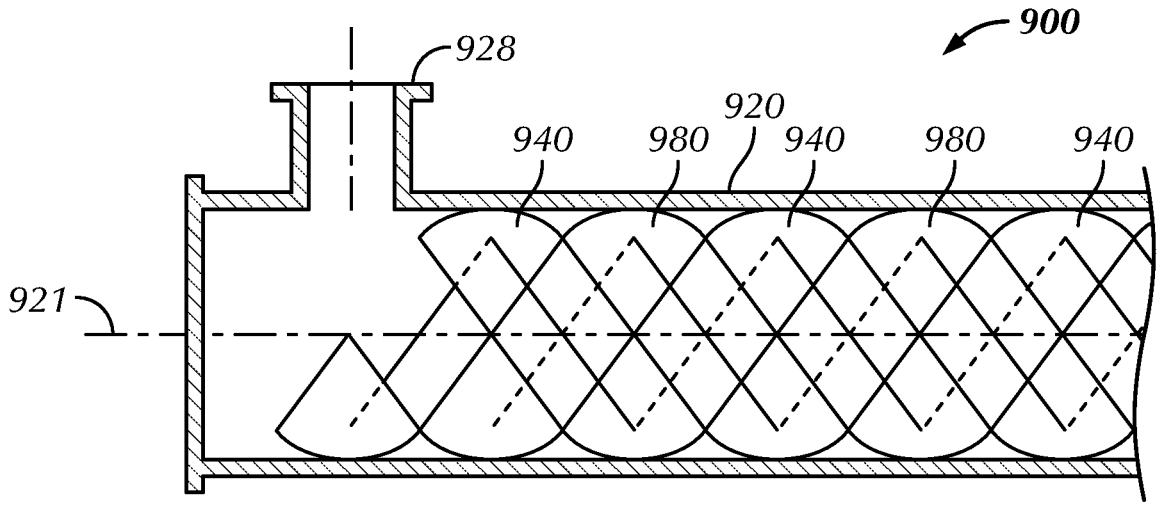
FIG. 9 illustrates a side view of a heat exchanger according to one or more embodiments of the present disclosure.

Referring now to FIG. 9, a heat exchanger 900 according to one or more embodiments of the present disclosure is shown. FIG. 9 illustrates a heat exchanger having a double helix flow pattern, which may include strips as described above between the helices. While the strips are not illustrated for ease of understanding the flow pattern, the description below is inclusive of the strips and illustrative of how the strips may be incorporated into a heat exchanger having multiple helical flow paths.

In one or more embodiments, a heat exchanger 900 may include a shell 920 through which a first fluid is passed, a plurality of axially extending tubes (not shown) through which a second fluid is passed, a first plurality of elliptical sector-shaped baffles 940, a second plurality of elliptical sector-shaped baffles 980 longitudinally offset from the first plurality of baffles 940, a first plurality of seal strips (not shown) each disposed between a first baffle 940 and a second baffle 980, and a second plurality of seal strips 960 disposed between the baffles 940. The shell may include an inlet 928 and an outlet (not shown) between which the first fluid may pass within the shell. Further, the plurality of tubes, the first plurality of baffles 940, the second plurality of baffles 980, the first plurality of seal strips, and the second plurality of seal strips may be disposed within the shell 920.

Still referring to FIG. 9, similar to heat exchangers discussed above, in one or more embodiments, the first plurality of baffles 940 may be disposed such that successive first baffles 940 are positioned at an angle from a line that is normal to a longitudinal axis 921 of the shell 920. In one or more embodiments, the first plurality of baffles 940 may be coupled about the longitudinal axis 920, and the successive first baffles 940 may be rotationally and longitudinally offset from each other such that a helical pattern is formed. The rotational offset between successive first baffles 940 may be such that at least a first radial edge (not shown) of one first baffle 940 overlaps a second radial edge (not shown) of an adjacent first baffle 940 in a longitudinal direction. Further, the longitudinal offset of the overlapping first radial edge and second radial edge between successive first baffles 940 may create a gap between the first radial edge and the second radial edge through which a first fluid flow may be able to travel. Further, as discussed above, in one or more embodiments, there may be an equal number of the first plurality of baffles 940 per 360° rotation about the longitudinal axis 921 about which the first plurality of baffles 940 are disposed.

Similarly, the second plurality of baffles 980 may be disposed such that successive second baffles 980 are positioned at an angle from a line that is normal to the longitudinal axis 921 of the shell 920. In one or more embodiments, the second plurality of baffles 980 may be coupled about the longitudinal axis 921, and the successive second baffles 980 may be rotationally and longitudinally offset from each other such that a helical pattern substantially identical to the helical pattern of the first plurality of baffles 940 is formed. The rotational offset between successive second baffles 980 may be such that at least a first radial edge (not shown) of one second baffle 980 overlaps a second radial edge (not shown) of an adjacent second baffle 980 in a longitudinal direction. Further, the longitudinal offset of the overlapping first radial edge and second radial edge between successive second baffles 980 may be the same as the longitudinal offset of the first baffles 940 and may create the same gap between the first radial edge and the second radial edge through which a first fluid flow may be able to travel. Further, as discussed above, in one or more embodiments, there may be an equal number of the second plurality of baffles 980 per 360° rotation about the longitudinal axis 921 about which the second plurality of baffles 980 are disposed. Additionally, the second plurality of baffles 980 may be longitudinally offset from the first plurality of baffles 940 such that the flow path between successive rotations of first baffles 920 is separated into two separate flow paths. In one or more embodiments, the second plurality of baffles may be longitudinally offset from the first plurality of baffles by half of a distance between first baffles 940 that are a 360° rotation from each other.

Further, in one or more embodiments, each of the first plurality of baffles 940 and the second plurality of baffles 980 may be elliptical sector-shaped. Each of the baffles 940, 980 may have an outer circumferential edge (not shown), and each outer circumferential edge may be spaced apart from the outer circumferential edge of an adjacent baffle 940, 980. Each of the baffles 940, 980 may also include the first radial edge at one end of the outer circumferential edge and the second radial edge at the other end of the outer circumferential edge such that the elliptical sector-shaped baffles 940, 980 are defined by the outer circumferential edge, the first radial edge, and the second radial edge. Furthermore, each of the baffles 940, 980 may have a first side (not shown) and a second side (not shown) that are opposite of each other as well as a plurality of spaced apart holes (not shown) that extend through the baffles 940, 980 from the first side to the second side. In one or more embodiments, each first baffle 940 may be aligned with an adjacent second baffle 980 such that the holes of each first baffle 940 aligns with the holes of the adjacent second baffle 980 and one tube of the plurality of axially extending tubes may pass through each of the holes in the baffles 940, 980. Therefore, as discussed above, the plurality of tubes may extend axially along an entire length of a heat exchanger 900, and each of the tubes may be supported by multiple baffles of each of the first plurality of baffles 940 and the second plurality of baffles 980. Furthermore, a distance between outer diameters of each of the tubes that are disposed in each of the holes may be consistent across the entirety of the plurality of tubes.

Furthermore, in one or more embodiments, a first plurality of seal strips may each be disposed between a first baffle of the first plurality of baffles 940 and a corresponding, adjacent baffle of the second plurality of baffles 940 that is aligned with the first baffle of the first plurality of baffles 940. In other words, each of the first plurality of seal strips may be coupled between one of the first side and the second side of one of the first plurality of baffles 940 and the corresponding first side or second side of one of the second plurality of baffles 980. Additionally, each of the first plurality of seal strips may be disposed within the shell 920 of the heat exchanger 900 as described above with regard to other embodiments, and each of the first plurality of seal strips may have a substantially similar structure to the first plurality of seal strips as described above with regard to other embodiments. Further, each of a second plurality of seal strips may be disposed between one of the first plurality of baffles 940 and a successive baffle of the first plurality of baffles 940 and between one of the second plurality of baffles 980 and a successive baffle of the second plurality of baffles 980 within the gaps formed between the first side of the one of the baffles 940, 980 and the second side of the successive baffle 940, 980 in a region in which the first radial edge of the one of the baffles 940, 980 overlaps with the second radial edge of the successive baffle 940, 980. Further, each of the second plurality of seal strips may be disposed within the shell 920 of the heat exchanger 900 as described above with regard to other embodiments, and each of the second plurality of seal strips may have a substantially similar structure to the second plurality of seal strips as described above with regard to other embodiments.

Embodiments disclosed herein are also directed toward methods of assembling of a heat exchanger. The method may include providing a center rod having a longitudinal axis and mounting a plurality of elliptical sector-shaped baffles to the center rod at an angle to the longitudinal axis of the center rod such that a helical pattern is formed by the plurality of baffles. Each of the plurality of baffles may include: an outer circumferential edge longitudinally spaced apart from the outer circumferential edge positions of the rest of the plurality of baffles; a proximal radial edge spaced from a distal radial edge; a proximal side opposite from a distal side; and a plurality of spaced apart holes. A plurality of axially extending tubes may be disposed into the plurality of spaced apart holes of each of the plurality of baffles, wherein the plurality of axially extending tubes are configured to carry a second fluid.

The method may further include coupling a first plurality of seal strips having a first end and a second end radially between the shell and the plurality of axially extending tubes. Coupling of the first plurality of seal strips may include: coupling the first end of each of the first plurality of seal strips to the distal side of one of the plurality of baffles; and coupling the second end of each of the first plurality of seal strips to the proximal side of another of the plurality of baffles. Each of the first plurality of seal strips is disposed either: orthogonal to both the distal side of the one of the plurality of baffles and the proximal side of the other of the plurality of baffles; or at an angle from orthogonal to the proximal side of one of the plurality of baffles and the distal side of another of the plurality of baffles, wherein the angle is from greater than 0° up to 80°. The assembled center rod, plurality of baffles, plurality of axially extending tubes, and first plurality of seal strips may then be disposed within a shell that is configured to receive a first fluid.

The coupled first plurality of seal strips have an inner diameter and an outer diameter. Coupling the first plurality of seal strips may include angling the coupled first plurality of seal strips from the outer diameter to the inner diameter by an angle from orthogonal to the shell in the direction defined from the proximal radial edge to the distal radial edge of the one of the plurality of baffles.

Coupling the first plurality of seal strips may further include spacing an inner diameter of each of the first plurality of seal strips from an outer diameter of a closest tube of the plurality of axially extending tubes by a distance that is equal to a distance between outer diameters of two adjacent tubes of the plurality of axially extending tubes.

Coupling the first plurality of seal strips may also include rotationally offsetting each of the first plurality of seal strips coupled to the distal side of each of the plurality of baffles from each of the plurality of seal strips coupled to the proximal side of each of the plurality of baffles.

The method of assembly may also include in some embodiments coupling a second plurality of seal strips having a first end and a second end radially between the shell and the plurality of axially extending tubes. Coupling the second plurality of seal strips may include: coupling the first end of each of the second plurality of seal strips to the distal radial edge of the distal side of one of the plurality of baffles; and coupling the second end of each of the second plurality of seal strips to the proximal radial edge of the proximate side of another of the plurality of baffles, wherein each of the second plurality of seal strips extends parallel to the longitudinal axis of the shell.

The heat exchanger according to one or more embodiments of the present disclosure that has seal strips disposed orthogonal to each of a plurality of baffles such that the seal strips are orthogonal to a direction of flow of a first fluid provides many benefits over conventional heat exchangers and other helically-baffled heat exchangers. For example, seal strips disposed orthogonal to each of the baffles may allow for a lower pressure drop over the entire length of the heat exchanger than heat exchangers that include seal strips that are disposed parallel to a longitudinal axis of the heat exchanger. Further, by way of example, seal strips disposed orthogonal to a direction of the first fluid flow and at an angle such that the first fluid flow is directed back towards a plurality of tubes carrying a second fluid may allow for less of the first fluid to bypass the plurality of tubes than seal strips that are disposed parallel to a longitudinal axis of the heat exchanger. Furthermore, by way of example, in one or more embodiments, radially offsetting the plurality of seal strips along a length of the heat exchanger may allow for providing local heat transfer enhancement to a greater number of the plurality of tubes. Additionally, by way of example, a second plurality of seal strips disposed adjacent to first and second radial edges of the baffles may allow for less of the first fluid to leave the helical flow path by leaking around the overlapping baffles. Therefore, the heat exchanger according to one or more embodiments may allow for an enhanced efficiency of heat transfer in addition to a lower cost of manufacturing and a lower cost of maintenance compared to that of conventional heat exchangers and other helically-baffled heat exchangers.

Several surprising results are noted with respect to embodiments of the present disclosure. First, experiments have shown that conventional seal strips, not arranged as disclosed herein, have little direct effect on heat transfer. In this way, they do not significantly improve the efficiency of heat exchangers to which they are added. In fact, these experiments have shown that conventional seal strips can cause significant pressure drops within heat exchangers, when compared to the same heat exchangers with no seal strips. The pressure drop may reduce the efficiency of heat transfer in the heat exchanger. This result is unexpected because prior art teaches that any seal strip improves the performance of a heat exchanger by preventing fluid from bypassing the tube bundle. Current findings show however that the seal strips arranged according to embodiments herein may improve the performance of a heat exchanger.

Figure 10:
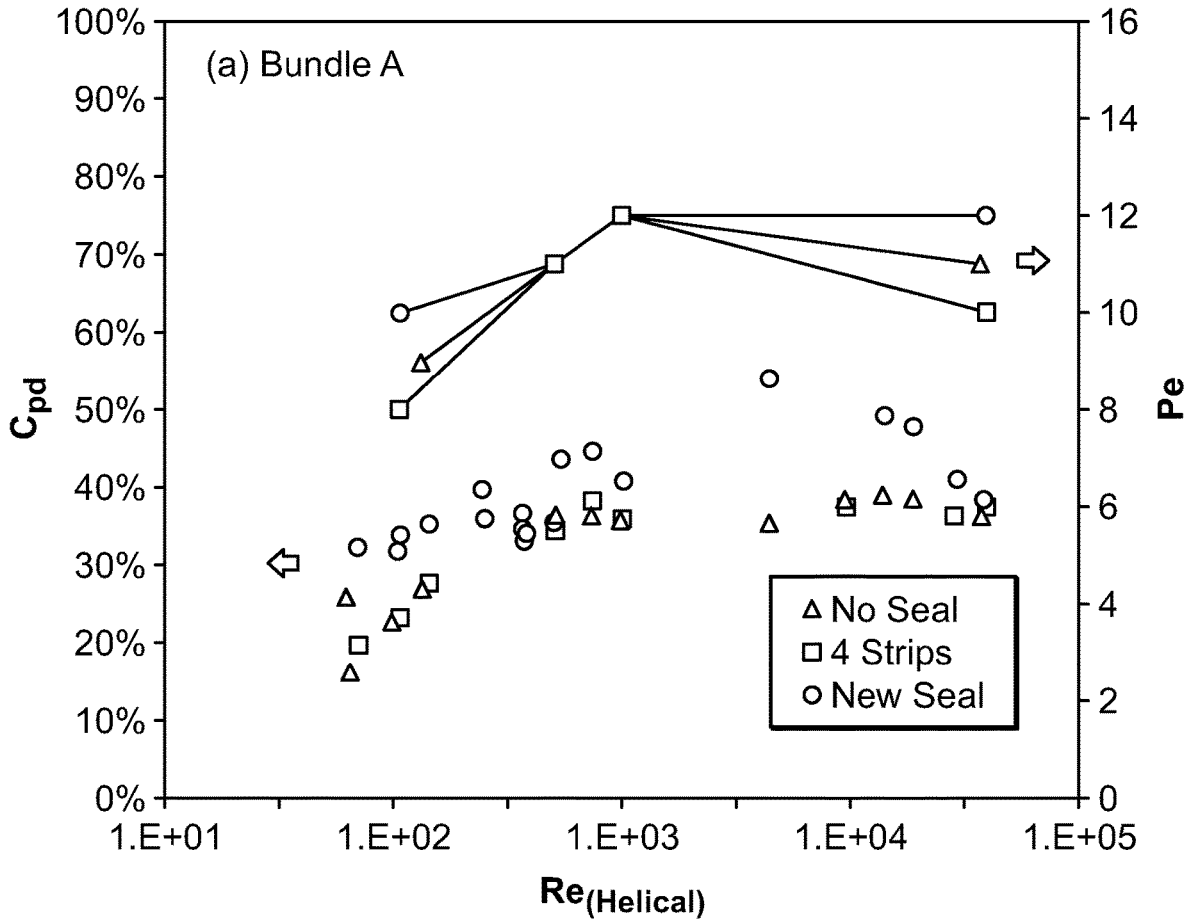
FIG. 10 is a graphical representation of data comparing a heat exchanger according to embodiments herein with prior art heat exchangers.

Referring now to FIG. 10, heat exchanger performance of three heat exchangers is compared: (1) a heat exchanger with no seal strips (triangles), (2) a heat exchanger including four longitudinal seal strips extending the length of the exchanger disposed through respective through-holes in each baffle (squares), and (3) a heat exchanger including angled seal strips, where the seal strips direct flow in a manner to encourage helical flow of fluid through the heat exchanger (circles). The experimental data is shown including the Reynolds number on the bottom axis, a pressure-drop conversion ratio on the left axis, and a Peclet number on the right axis. As shown, for the given Reynolds number of the fluid flow, the pressure-drop conversion ratio and Peclet numbers improve for the seal strips arranged according to embodiments herein, indicating a higher efficiency of conversion of pressure drop to heat transfer.

Second, experiments have shown that seal strips connected such that they oppose fluid flow, i.e. connected in reverse from what is taught herein, can significantly reduce heat transfer. In some experiments, these seal strips reduced heat transfer as much as 60% relative to heat exchangers with no seal strips. This is surprising because sealing of any type is expected to prevent bypassing and thereby improve heat transfer. These results demonstrate however, that not only must bypassing be prevented, but significant pressure drops also must be avoided, in order to improve the heat transfer in a heat exchanger. Accordingly, the specific arrangement and orientation of seal strips taught herein is important in achieving improved heat transfer.

Third, experiments have shown that seal strips connected as disclosed herein can increase heat transfer without causing significant pressure drops. These seal strips are connected to encourage helical flow of fluid through the heat exchanger. This is unexpected because prior art teaches that any sealing causes a pressure drop penalty of approximately 30%-50%. Therefore, the results of the present disclosure are more significantly positive than would have been expected based on the prior art, because they provide improved heat transfer without a corresponding increased pressure drop.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A heat exchanger comprising:

a shell having a longitudinal axis and configured to receive a first fluid;

a plurality of baffles each mounted in the shell at a helix angle $H_B$ to guide a first fluid flow into a helical pattern through the shell, wherein each of the plurality of baffles comprises:

an outer circumferential edge longitudinally spaced apart from the outer circumferential edge positions of the rest of the plurality of baffles;

a proximal radial edge spaced from a distal radial edge;

a proximal side opposite from a distal side; and a plurality of spaced apart holes configured to be traversed by a plurality of axially extending tubes configured to carry a second fluid; and a first plurality of seal strips, each having a first end and a second end, radially disposed between the shell and the plurality of axially extending tubes and each respectively positioned between any two adjacent baffles;

wherein each of the first plurality of seal strips is disposed to have the first end of each seal strip proximate to the distal side of a respective baffle and the second end of each seal strip proximate to the proximal side of a respective baffle at a helix angle $H_s$ that is greater than 5° and less than the baffle helix angle $H_B$, where the helix angles $H_B$ and $H_s$ are defined as the angle of the respective baffle or seal strip relative to the longitudinal axis of the shell, and wherein each of the first plurality of seal strips have an angle greater than 0° up to 80° formed between each of the first plurality of seal strips and a line orthogonal to the proximal side of the respective baffle and the distal side of the respective baffle.

2. The heat exchanger of claim 1, wherein the seal strips, in part, are configured in part to direct a flow of fluid helically toward an outlet and in part to direct a flow of fluid away from the shell and toward the plurality of axially extending tubes.

3. The heat exchanger of claim 1, wherein:

the first plurality of seal strips are disposed from a distal side of a first baffle from adjacent to a proximal radial edge of the first baffle to a proximal side of a second baffle adjacent to a distal radial edge of the second baffle, wherein the first and second baffles are located in a same sector or quadrant; or the first plurality of seal strips are disposed from a distal side of a first baffle from intermediate the proximal radial edge and distal radial edge of the first baffle to a proximal side of a second baffle intermediate a proximal radial edge and a distal radial edge of the second baffle, wherein the second baffle is located in a different sector or quadrant than the first baffle.

4. The heat exchanger of claim 1, wherein the first end of each of the first plurality of seal strips is coupled to the distal side of a first of the plurality of baffles, and wherein the second end of each of the first plurality of seal strips is coupled to the proximal side of a second of the plurality of baffles.

5. The heat exchanger of claim 1, wherein the plurality of baffles are elliptical sector-shaped baffles.

6. The heat exchanger of claim 1, wherein the first plurality of seal strips have an inner surface and an outer surface, and wherein the first plurality of seal strips are angled from the outer surface to the inner surface by an angle from orthogonal to the shell in the direction defined from a proximal radial edge to a distal radial edge of the one of the plurality of baffles.

7. The heat exchanger of claim 6, wherein each of the first plurality of seal strips is angled by 15° up to 45° from orthogonal to the shell.

8. The heat exchanger of claim 1, wherein an outer surface of each of the first plurality of seal strips is disposed proximate to an inner surface of the shell.

9. The heat exchanger of claim 1, wherein an inner surface of each of the first plurality of seal strips is spaced from an outer surface of a closest tube of the plurality of axially extending tubes by a distance that is equal to a distance between outer diameters of two adjacent tubes of the plurality of axially extending tubes.

10. The heat exchanger of claim 1, wherein each of the plurality of baffles includes at least one of the first plurality of seal strips coupled to the proximal side and at least one of the first plurality of seal strips coupled to the distal side.

11. The heat exchanger of claim 1, wherein each of the first plurality of seal strips coupled to the distal side of each of the plurality of baffles is offset rotationally about the longitudinal axis from each of the plurality of seal strips coupled to the proximal side of each of the plurality of baffles.

12. The heat exchanger of claim 1, wherein each of the first plurality of seal strips have a curved outer diameter with a curvature that is elliptical and wherein each of the first plurality of seal strips have a curved inner diameter with a curvature that is elliptical.

13. The heat exchanger of claim 1, wherein each of the first plurality of seal strips has a width, outer diameter minus inner diameter, that varies along a length, first end to second end, of the seal strip, and wherein each of the first plurality of seal strips has a depth, proximal side to distal side, that varies along the width or the length of the seal strip.

14. The heat exchanger of claim 1, wherein an equal number of seal strips are coupled to each baffle of the plurality of baffles.

15. The heat exchanger of claim 1, wherein a number of seal strips per rotation about the longitudinal axis of the shell is a multiple of a number of baffles per rotation about the longitudinal axis of the shell.

16. The heat exchanger of claim 1, wherein the first plurality of seal strips are formed of steel.

17. The heat exchanger of claim 1, further comprising:

a second plurality of seal strips, each having a first end and a second end radially disposed between the shell and the plurality of axially extending tubes and each respectively positioned between any two baffles, wherein each of the second plurality of seal strips is disposed from a proximal of the plurality of baffles to a distal of the plurality of baffles at a helix angle $H_{2s}$ that is greater than 5°, different than helix angle $H_s$, and less than the baffle helix angle $H_B$, where the helix angles $H_B$, $H_s$, $H_{2s}$ are defined as the angle of the respective baffle or seal strip relative to the longitudinal axis of the shell.

18. The heat exchanger of claim 1, further comprising:

a second plurality of seal strips, each having a first end and a second end radially disposed between the shell and the plurality of axially extending tubes and each respectively positioned between any two adjacent baffles, wherein each of the second plurality of seal strips is disposed from a proximal radial edge of a baffle to a distal radial edge of the adjacent baffles.

19. The heat exchanger of claim 18, wherein an inner surface of each of the second plurality of seal strips is spaced from an outer surface of a closest tube of the plurality of axially extending tubes by a distance that is equal to a distance between outer diameters of two adjacent tubes of the plurality of axially extending tubes.

20. A method of assembling of a heat exchanger, the method comprising:

providing a center rod having a longitudinal axis;

mounting a plurality of elliptical sector-shaped baffles to the center rod at an angle to the longitudinal axis of the center rod such that a helical pattern is formed by the plurality of baffles, wherein each of the plurality of baffles comprises:

an outer circumferential edge longitudinally spaced apart from the outer circumferential edge positions of the rest of the plurality of baffles;

a proximal radial edge spaced from a distal radial edge;

a proximal side opposite from a distal side; and a plurality of spaced apart holes;

disposing a plurality of axially extending tubes into the plurality of spaced apart holes of each of the plurality of baffles, wherein the plurality of axially extending tubes are configured to carry a second fluid;

coupling a first plurality of seal strips, each having a first end and a second end, radially between a shell and the plurality of axially extending tubes, wherein coupling the first plurality of seal strips includes:

coupling the first end of each of the first plurality of seal strips to the proximal side of one of the plurality of baffles;

coupling the second end of each of the first plurality of seal strips to the distal side of an adjacent baffle to the one of the plurality of baffles, wherein each of the first plurality of seal strips is disposed at a helix angle $H_s$ that is greater than 5° and less than the baffle helix angle $H_B$, where the helix angles $H_B$ and $H_s$ are defined as the angle of the respective baffle or seal strip relative to the longitudinal axis of the shell; and angling each of the first plurality of seal strips to form an angle greater than 0° up to 80° between each of the first plurality of seal strips and a line orthogonal to the proximal side of the respective baffle and the distal side of the respective baffle; and disposing the assembled center rod, plurality of baffles, plurality of axially extending tubes, and first plurality of seal strips within the shell that is configured to receive a first fluid.

21. The method of assembly of claim 20, wherein the coupled first plurality of seal strips have an inner surface and an outer surface, and wherein coupling the first plurality of seal strips further includes:

angling the coupled first plurality of seal strips from the outer surface to the inner surface by an angle from orthogonal to the shell in the direction defined from the proximal radial edge to the distal radial edge of the one of the plurality of baffles.

22. The method of assembly of claim 20, wherein coupling the first plurality of seal strips further includes:

spacing an inner surface of each of the first plurality of seal strips from an outer surface of a closest tube of the plurality of axially extending tubes by a distance that is equal to a distance between outer diameters of two adjacent tubes of the plurality of axially extending tubes.

23. The method of assembly of claim 20, wherein coupling the first plurality of seal strips further includes:

rotationally offsetting each of the first plurality of seal strips coupled to the distal side of each of the plurality of baffles from each of the plurality of seal strips coupled to the proximal side of each of the plurality of baffles.

24. The method of assembly of claim 20, further comprising:

coupling a second plurality of seal strips having a first end and a second end radially between the shell and the plurality of axially extending tubes, wherein coupling the second plurality of seal strips includes:

coupling the first end of each of the second plurality of seal strips to the proximal radial edge of the distal side of one of the plurality of baffles; and coupling the second end of each of the second plurality of seal strips to the distal radial edge of the proximate side of another of the plurality of baffles, wherein each of the second plurality of seal strips extends parallel to the longitudinal axis of the shell.

25. A heat exchanger, comprising:

a shell having a longitudinal axis and configured to receive a first fluid;

a plurality of baffles mounted in the shell at an angle to the longitudinal axis, spaced apart from each other along the longitudinal axis, and configured to guide a flow of the first fluid along a helical pattern through the shell, each of the baffles comprising:

an outer circumferential edge;

a proximal radial edge spaced from a distal radial edge;

a proximal side opposite from a distal side; and a plurality of spaced apart holes formed through each baffle from the proximal side to the distal side, the holes configured to be traversed by a plurality of axially extending tubes with the tubes configured to carry a second fluid; and a plurality of seal members, each comprising a first end and a second end, the seal members radially disposed between the shell and the plurality of axially extending tubes, and the first end of each seal member coupled to the distal side of a respective baffle and the second end of each seal member coupled to the proximal side of a respective baffle, wherein each seal member is disposed at an angle from orthogonal to the proximal side of the respective baffle, and the angle is from greater than 0° up to 80° in a direction defined from the proximal radial edge to the distal radial edge of the respective baffle.

26. The heat exchanger of claim 25, wherein the seal members comprise seal strips or seal rods.

27. A heat exchanger comprising:

a shell having a longitudinal axis and configured to receive a first fluid;

a plurality of baffles each mounted in the shell at a helix angle $H_B$ to guide a first fluid flow into a helical pattern through the shell, wherein each of the plurality of baffles comprises:

an outer circumferential edge longitudinally spaced apart from the outer circumferential edge positions of the rest of the plurality of baffles;

a proximal radial edge spaced from a distal radial edge;

a proximal side opposite from a distal side; and a plurality of spaced apart holes configured to be traversed by a plurality of axially extending tubes configured to carry a second fluid; and a first plurality of circumferentially offset seal strips, each having a first end and a second end, radially disposed between the shell and the plurality of axially extending tubes and each respectively positioned between any two adjacent baffles, wherein each of the first plurality of circumferentially offset seal strips have an angle greater than 0° up to 80° formed between each of the first plurality of circumferentially offset seal strips and a line orthogonal to the two adjacent baffles.

28. The heat exchanger of claim 27, wherein each of the plurality of baffles is connected to at least two of the first plurality of seal strips, including a distal seal strip connected to a distal side of a baffle, and a proximal seal strip connected to a proximal side of the same baffle, and wherein the proximal seal strip is circumferentially offset from the distal seal strip.

29. The heat exchanger of claim 27, wherein each of the first plurality of seal strips is parallel to a longitudinal axis of the heat exchanger.

* * * * *